US010905174B2

(12) United States Patent
Langer et al.

(10) Patent No.: US 10,905,174 B2
(45) Date of Patent: Feb. 2, 2021

(54) UPPER BODY ARTICLE OF APPAREL

(71) Applicant: FALKE KGaA, Schmallenberg (DE)

(72) Inventors: Angela Langer, Schmallenberg (DE); Claudius Brinkmann, Bad Fredeburg (DE); Georg Wüllner, Schmallenberg-Bödefeld (DE)

(73) Assignee: FALKE KGaA, Schmallenberg (DE)

( * ) Notice: Subject to any disclaimer, the term of this patent is extended or adjusted under 35 U.S.C. 154(b) by 670 days.

(21) Appl. No.: 14/641,215

(22) Filed: Mar. 6, 2015

(65) Prior Publication Data

US 2015/0173430 A1 Jun. 25, 2015

Related U.S. Application Data

(63) Continuation of application No. PCT/EP2013/068916, filed on Sep. 12, 2013.

(30) Foreign Application Priority Data

Sep. 12, 2012 (DE) ..... 10 2012 216 180

(51) Int. Cl.
*A41D 1/08* (2018.01)
*A41D 13/00* (2006.01)
(Continued)

(52) U.S. Cl.
CPC ..... *A41D 1/08* (2013.01); *A41D 13/0015* (2013.01); *A41D 31/18* (2019.02); *A41B 11/003* (2013.01)

(58) Field of Classification Search
CPC ..... A41D 13/0015; A41D 1/08; A41B 9/06
(Continued)

(56) References Cited

U.S. PATENT DOCUMENTS 3,013,420 A 12/1961 Cormier
3,159,990 A 12/1964 Monday
(Continued)

FOREIGN PATENT DOCUMENTS

AT 193541 11/1957
AT 11230 7/2010
(Continued)

OTHER PUBLICATIONS

United States Patent and Trademark Office, "Restriction," issued in connection with U.S. Appl. No. 14/641,195, dated May 17, 2017 (9 pages).

(Continued)

*Primary Examiner* — Gloria M Hale
(74) *Attorney, Agent, or Firm* — Hanley, Flight & Zimmerman, LLC

(57) ABSTRACT

In order to provide an upper body article of apparel, in particular a shirt, a bodysuit, an undershirt or an oversleeve which is suitable for reducing the risk of injury to the wearer of the upper body article of apparel, particularly during sports activities and to achieve compensation of possible functional imbalances in the musculoskeletal system of the wearer, it is proposed that the upper body article of apparel comprises at least one compression region in which, in the worn state, the upper body article of apparel exerts a compression effect on the body of the wearer of the upper body article of apparel, and comprises at least one stimulus-inducing structure which, in the worn state, is arranged on an inside of the upper body article of apparel facing toward the body of the wearer of the upper body article of apparel.

33 Claims, 13 Drawing Sheets

(51) Int. Cl.
*A41D 31/18* (2019.01)
*A41B 11/00* (2006.01)

(58) Field of Classification Search
USPC ..... 2/113, 112, 79, 69
See application file for complete search history.

(56) References Cited

U.S. PATENT DOCUMENTS 3,216,223 A 11/1965 Margulies
4,216,547 A 8/1980 Picchione
4,333,976 A 6/1982 Okamoto et al.
4,372,998 A 2/1983 Shimada
5,263,923 A * 11/1993 Fujimoto ..... A41D 13/0015 602/62
5,329,640 A 7/1994 Hourigan
5,791,164 A 8/1998 Carroll et al.
5,857,947 A 1/1999 Dicker et al.
6,138,281 A 10/2000 Chiaruttini
6,311,334 B1 * 11/2001 Reinhardt ..... A61F 13/08 2/239
6,314,584 B1 11/2001 Errera
6,378,138 B1 4/2002 Ridgley et al.
6,446,264 B2 9/2002 Fairhurst et al.
6,673,421 B1 * 1/2004 Andrews ..... A41B 11/04 2/239
7,434,423 B1 * 10/2008 Reid, Jr. ..... A61F 13/08 66/178 A
7,516,498 B2 4/2009 Torry
7,934,267 B2 5/2011 Nordstrom et al.
7,996,924 B2 * 8/2011 Wright ..... A41B 11/00 2/239
2004/0016041 A1 1/2004 Uno et al.
2004/0255358 A1 * 12/2004 Ota ..... A41D 13/0015 2/69
2005/0115282 A1 * 6/2005 Starbuck ..... D04B 1/24 66/176
2005/0193461 A1 * 9/2005 Caillibotte ..... A41D 13/0015 2/69
2006/0026740 A1 2/2006 Vargas et al.
2006/0080754 A1 * 4/2006 Baron ..... A41D 13/002 2/85
2006/0169004 A1 8/2006 Belluye et al.
2006/0230488 A1 10/2006 Rudolph
2006/0260024 A1 11/2006 Lee
2007/0074328 A1 * 4/2007 Melhart ..... A41D 13/0015 2/69
2008/0083055 A1 * 4/2008 Onda ..... A41D 13/0015 2/455
2008/0178359 A1 7/2008 Grilliot et al.
2008/0295216 A1 * 12/2008 Nordstrom ..... A41D 13/0015 2/69
2008/0295230 A1 * 12/2008 Wright ..... A41D 13/0015 2/455
2009/0025115 A1 * 1/2009 Duffy ..... A41D 13/0015 2/69
2009/0062704 A1 * 3/2009 Brown ..... A41D 13/0015 602/19
2009/0133181 A1 * 5/2009 Nordstrom ..... A41D 31/185 2/115
2009/0275873 A1 11/2009 Achtelstetter
2010/0004563 A1 1/2010 Lipshaw
2010/0010568 A1 * 1/2010 Brown ..... A41D 13/0015 607/48
2010/0050313 A1 * 3/2010 Shackelford, Jr. ..... A41D 13/1245 2/69
2010/0050699 A1 * 3/2010 Kolmes ..... A41B 9/00 66/174
2010/0130903 A1 * 5/2010 Rock ..... A41D 13/0015 602/62
2010/0256717 A1 * 10/2010 Brown ..... A61F 5/026 607/115
2010/0299799 A1 12/2010 Belluye et al.
2011/0040222 A1 2/2011 Weihermueller
2011/0083246 A1 * 4/2011 Vitarana ..... A41D 13/0015 2/69
2011/0092872 A1 4/2011 Christiansen
2011/0107502 A1 5/2011 Dalhausser et al.
2011/0302686 A1 * 12/2011 Chapuis ..... A41D 13/0015 2/69
2012/0070608 A1 * 3/2012 Rock ..... D04B 1/246 428/89
2014/0230124 A1 8/2014 Wilms-Otto
2015/0173428 A1 6/2015 Langer et al.

FOREIGN PATENT DOCUMENTS

CN 101715306 5/2010
CN 201459349 5/2010
CN 101766334 7/2010
CN 201929003 U 8/2011
CN 102264252 11/2011
CN 102273741 12/2011
CN 202085728 12/2011
CN 202143449 U 2/2012
DE 1842303 11/1961
DE 19946019 3/2003
DE 102009050031 3/2011
DE 202012007243 10/2012
EP 0553615 8/1993
EP 0919145 6/1999
EP 0964091 12/1999
EP 1074652 2/2001
EP 1241286 10/2001
FR 2115802 7/1972
GB 1444445 7/1976
GB 1552320 9/1979
GB 2029468 3/1980
JP 2012-052276 3/2012
WO 2007046298 4/2007
WO 2007147980 12/2007
WO 2012114209 8/2012
WO 2013053370 4/2013

OTHER PUBLICATIONS

State of Intellectual Property Office of the People's Republic of China, English version of "Notification of Second Office Action," issued in connection with Chinese Application No. 201380047524.X, dated Sep. 26, 2016, 20 pages.
Hairu, Rough English machine translation of "Knitting Technology," China Textile Press, pp. 71-75, Jun. 2004, 13 pages.
State of Intellectual Property Office of the People's Republic of China, English version of "Notification of First Office Action," issued in connection with Chinese Application No. 201380047479.8, dated Nov. 27, 2015, 15 pages.
State of Intellectual Property Office of the People's Republic of China, English version of "Notification of First Office Action," issued in connection with Chinese Application No. 201380047524.X, dated Nov. 17, 2015, 23 pages.
International Searching Authority, "Written Opinion," issued in connection with PCT Application No. PCT/EP2013/068914, dated Dec. 11, 2013, 6 pages.
International Searching Authority, English version of "International Search Report," issued in connection with PCT Application No. PCT/EP2013/068914, dated Dec. 11, 2013, 6 pages.
International Searching Authority, "International Search Report," issued in connection with PCT Application No. PCT/EP2013/068916, dated Dec. 11, 2013, 6 pages.
International Searching Authority, "Written Opinion," issued in connection with PCT Application No. PCT/EP2013/068916, dated Dec. 11, 2013, 6 pages.
German Patent Office, "First Office Action," issued in connection with German Application No. 10 2012 216 180.5, dated Apr. 25, 2013, 5 pages.
Chinese Patent Office, English version of "Notification of the Third Office Action," issued in connection with CN Application No. 201380047524.X, dated Jun. 16, 2017 (23 pages).

(56) References Cited

OTHER PUBLICATIONS

United States Patent and Trademark Office,"Office Action," issued in connection with U.S. Appl. No. 14/641,195, dated Sep. 19, 2017, 38 pages.
European Patent Office, English machine translation of "European Search Report", issued in connection with European Patent Application No. 17175094.6, dated Oct. 9, 2017, 6 pages.
Eruopean Patent Office, "European Search Report," issued in connection with International Patent Application No. 17175200.9, dated Sep. 5, 2017, 6 pages.
United States Patent and Trademark Office, "Final Office Action," issued in connection with U.S. Appl. No. 14/641,195, dated Feb. 28, 2018, 53 pages.
English version of European Patent Office, "Notice of Opposition," issued in connection with European Patent No. 2895021, dated Apr. 18, 2018, 45 pages.
G.G. Hohlbaum, "The medical compression stocking," Schattauer Verlag, 1987, Germany, 147 pages (Partial English translation included).
Photographs of samples of a pantyhose "Compressana magic" and of sports trunks "Compressana magic pants" and the respective packaging, 2 pages.
A variety of articles from professional journals published in the years Jan. through Mar. 1999 through 2001, reporting on the product "Compressana magic," 38 pages.
An invoice issued by the Italian manufacturing company Calzificio Pinelli to the German sales company Compressana GmbH, related to the delivery of trunks and pantyhoses of the type "magic", dated Jun. 3, 1999, 1 page.
Information materials and advertising materials of the company Compressana GmbH concerning the pantyhose "Compressana magic" and the trunks "Compressana magic pants", which allegedly were distributed on the tradeshow "Expopharm 1999" in Leipzig, Germany, together with a letter to the management of the tradeshow dated Sep. 28, 1999, to which these information and advertising materials allegedly were attached, 13 pages.
An excerpt from the price list 2001 of the company Compressana GmbH, wherein the pantyhose "Compressana magic" and the trunks "Compressana magic pants" are offered for sale, 3 pages.
English version of European Patent Office, "Notice of Opposition," issued in connection with European Patent No. 2895020, dated Apr. 17, 2018, 48 pages.
Chinese Patent Office, "First Office Action," issued in connection with Chinese Patent Application No. 201811018930.4, dated Nov. 25, 2019, 26 pages. English version included.
China National Intellectual Property Administration, "Notification of First Office Action and Search Report," issued in connection with Chinese Patent Application No. 201810756316.1, dated Jul. 25, 2019, 18 pages. English version included.
European Patent Office, "Short Communication Reporting Opponent Letter," issued in connection with European Patent Application No. 13762120.7, dated Aug. 7, 2019, 2 pages. Rough machine translated English version included.
European Patent Office, "Brief of the Opponent in the Opposition Proceedings Against the Corresponding European Patent No. 2 895 021," issued in connection with the European Patent Application No. 13762120.7, mailed Aug. 15, 2019, 30 pages. Rough machine translated English version included.
Wikipedia Contributors, "Musculus Erector Spinae and Musculus Triceps Brachii," The Free Encyclopedia, Aug. 8, 2019, 14 pages. Rough machine translated English version included.
European Patent Office, "Short Communication Reporting Opponent Letter," issued in connection with European Patent Application No. 13762119.9, dated Aug. 7, 2019, 2 pages. Rough machine translated English version included.
European Patent Office, "Brief of the Opponent in the Opposition Proceedings Against the Corresponding European Patent No. 2 895 020," issued in connection with the European Patent Application No. 13762119.9, mailed Aug. 15, 2019, 29 pages. Rough machine translated English version included.
Chinese Patent Office, "First Office Action," issued in connection with Chinese Patent Application No. 201811019637.X, dated Mar. 9, 2020, 18 pages. English version included.
United States Patent and Trademark Office, "Corrected Notice of Allowability," issued in connection with U.S. Appl. No. 14/641,195, dated Aug. 13, 2020, 6 pages.
China Intellectual Property Administration, "Notification of the Second Office Action," issued in connection with Chinese Patent Application No. 201811018930.4, dated Jun. 23, 2020, 38 pages. English translation included.
Liu, Sen and Yang, Biling, "Introduction to Textile Dyeing," Beijing China Textile & Apparel Press, Mar. 31, 2017, 6 pages. English translation included.
Wang, Lu, "Sportswear Design Innovation," China Light Industry Press, Sep. 30, 2008, 4 pages. English translation included.
China Intellectual Property Administration, "Notification of the Third Office Action," issued in connection with Chinese Patent Application No. 201810756316.1, dated Sep. 7, 2020, 24 pages. English translation included.
Xia, Zhengnong, "Comprehensive Dictionary Volume of Chemical Industry Light Industry Textile," 1Edition, Shanghai Lexicographic Publishing House, Aug. 31, 2009, 8 pages. English translation of p. 255 included.

* cited by examiner

UPPER BODY ARTICLE OF APPAREL

RELATED APPLICATION

This application is a continuation application of PCT/EP2013/068916 filed on Sep. 12, 2013, the entire specification of which is incorporated herein by reference.

FIELD OF DISCLOSURE

The present invention relates to an upper body article of apparel.

The expression "upper body article of apparel" covers every garment which is worn close to the body in the region of the upper body of the wearer including the arms, in particular shirts, bodysuits, undershirts and sleeves.

SUMMARY OF THE INVENTION

It is an object of the present invention to provide an upper body article of apparel of this type which is suitable for reducing the risk of injury to the wearer of the upper body article of apparel, particularly during sports activities and to achieve balancing out of possible functional imbalances in the musculoskeletal system of the wearer and to achieve performance optimisation in the sensory activity.

This object is achieved according to the invention with an upper body article of apparel, in particular a shirt, a bodysuit, an undershirt or an oversleeve which comprises at least one compression region in which, in the worn state, the upper body article of apparel exerts a compression effect on the body of the wearer of the upper body article of apparel, and at least one stimulus-inducing structure which, in the worn state, is arranged on an inside of the upper body article of apparel facing toward the body of the wearer of the upper body article of apparel.

The present invention is based on the concept of exerting a proprioceptive stimulating effect on the wearer of the upper body article of apparel by means of the stimulus-inducing structure, wherein the proprioceptive stimulating effect of the stimulus-inducing structure is amplified by the simultaneous compression effect of the upper body article of apparel on the upper body of the wearer.

From the field of physiology, it is known that a neurophysiological initiation of the proprioceptors of the wearer (that is, the receptors which enable the perception and control of the current position of the body of the wearer in space, in particular the muscle spindles, the Golgi tendon organ and the joint receptors) can be achieved through stimulation via the skin.

Through stimulation of the proprioceptors of the body (neurophysiological initiation), improved synchronisation and optimisation of the recruited muscles of the wearer is achieved, which becomes noticeable in improved physical stability, body balance and body posture.

Thus by stimulation of the proprioceptors, not only is the risk of injury reduced, particularly during sports activity, but balancing out of functional imbalances in the musculoskeletal system can also be achieved.

An improvement in body stability and/or a reduction in imbalances in the musculoskeletal system bring about a balanced, symmetrical posture of the wearer, which results in lower loading, a delayed fatiguing tendency and a prolonged tendency in the wearer to feel a sense of wellbeing.

The proprioceptive stimulation of the musculature of the wearer of the upper body article of apparel brings about a reduced risk of injury through incorrect movements and overstretching, as well as optimisation and synchonisation of the bodily coordination of the wearer.

The upper body article of apparel according to the invention enables the positive effect of proprioceptive stimulation to be used, including particularly in the domain of mass sports, for preventative uses, for example, in the business field, and/or in the wellness or cosmetic fields.

The upper body article of apparel according to the invention is a garment worn close to the body which enables effective proprioceptive stimulation of the musculature of the wearer in a simple and easily usable manner.

The upper body article of apparel according to the invention can be configured, in particular, as a shirt with or without arm regions.

The proprioceptive stimulation desired according to the invention is achieved, in particular, through a specific attachment of at least one stimulus-inducing structure having functional elements which exert a sensory stimulating effect on the musculature of the wearer, on the inside of the upper body article of apparel facing toward the body of the wearer.

The stimulus-inducing structure is preferably arranged at a position of the upper body article of apparel which, in the worn state of the upper body article of apparel, is associated with a region of the body of the wearer which has the greatest possible proprioceptor density.

Preferred regions of the arrangement of the stimulus-inducing structure are the courses of the myofascial chains which run helically upwardly, starting at the foot, via the leg region to the head.

In a preferred embodiment of the upper body article of apparel according to the invention, it is provided that those regions of the upper body article of apparel which, in the worn state of the upper body article of apparel, make contact with the thoracic region, the spinous processes of the vertebral column and/or with the neck region of the wearer remain free from stimulus-inducing structures in order reliably to prevent potential faulty stimulation at these sites and a possible risk of irritation and nerve stimulation and to increase wearing comfort.

By means of isolated application of pressure on the skin of the wearer along a muscle chain of the wearer, stimulation of the muscle activity of the wearer can be achieved.

Since the compression effect of the compression region amplifies the proprioceptive stimulating effect of the stimulus-inducing structure, it is favourable if the stimulus-inducing structure is arranged at least partially, preferably substantially entirely, in the at least one compression region of the upper body article of apparel.

It is also advantageous for the effectiveness of the proprioceptive stimulating effect of the stimulus-inducing structure if the stimulus-inducing structure, in the worn state of the upper body article of apparel, is in direct contact with the skin of the wearer of the upper body article of apparel.

Alternatively thereto, it can also be provided that, in the worn state of the upper body article of apparel, at least one stimulus-inducing structure is separated from the skin of the wearer by a covering.

In particular it can be provided that at least one stimulus-inducing structure is covered by a textile construction.

Thus it is possible, particularly depending on the configuration of functional elements of the stimulus-inducing structure with regard to their hardness, height and pointedness, to allow these functional elements to act indirectly on the skin of the wearer of the upper body article of apparel.

The compression region of the upper body article of apparel preferably comprises an elastically yielding material.

In particular, it can be provided that the compression region of the upper body article of apparel comprises a knitted fabric.

Preferably, the compression region of the upper body article of apparel comprises at least one elastic yarn, for example, elastane.

The compression region can in principle have a compression strength which is substantially constant.

In a preferred embodiment of the invention, however, it is provided that the compression region has a gradual progression of the compression strength.

In particular, if the compression region is arranged in a trunk region or an arm region of the upper body article of apparel, it is advantageous if the compression strength in the compression region decreases in the direction toward a chest region of the upper body article of apparel.

If the upper body article of apparel comprises an elbow region which, in the worn state of the upper body article of apparel, covers an elbow of the wearer, then the compression region preferably does not comprise the elbow region of the upper body article of apparel.

The maximum compression strength in the compression region is preferably at least approximately 7 mm Hg, particularly at least approximately 10 mm Hg.

Furthermore, it is favourable if the maximum compression strength in the compression region is preferably not more than approximately 32 mm Hg, particularly not more than approximately 25 mm Hg.

In preferred embodiments of the upper body article of apparel according to the invention, at least one compression region comprises at least a part of a trunk region, at least a part of an upper arm region and/or at least a part of a forearm region of the upper body article of apparel.

In the trunk region of the upper body article of apparel, the relative compression strength in the chest region is preferably from zero to approximately 30% of the maximum compression strength in the trunk region and in the shoulder region, is preferably from zero to approximately 60% of the maximum compression strength in the trunk region.

The maximum compression strength in the trunk region of the upper body article of apparel is preferably not more than approximately 12 mm Hg.

In the case of long arm regions of the upper body article of apparel fixedly connected to a trunk region of the upper body article of apparel, covering the whole arm as far as the wrist, the maximum compression strength in the arm region is preferably not more than approximately 32 mm Hg, particularly preferably not more than approximately 25 mm Hg.

In the long arm regions, the compression strength preferably decreases gradually from the wrist region to the region of the shoulder joint.

In the region of the elbow joint, the upper body article of apparel preferably has no compression.

If the upper body article of apparel has a trunk region and arm regions, the compression strength in the shoulder region of the arm regions is preferably substantially the same as the compression strength in the shoulder region of the trunk region.

In the case of short arm regions fixedly connected to a trunk region of the upper body article of apparel, only beginning above the elbow joint, the maximum compression strength in the arm regions is preferably not more than approximately 18 mm Hg, particularly preferably not more than approximately 15 mm Hg.

In the case of arm regions not connected to a trunk region, sleeves or "oversleeves" which preferably cover the arm of the wearer substantially from the wrist to the upper arm, inclusively, the maximum compression strength is preferably not more than approximately 32 mm Hg, particularly preferably not more than approximately 25 mm Hg.

The compression strength of the sleeves preferably decreases gradually from the wrist to the shoulder joint. It can also be provided that the sleeves have no compression in the region of the elbow joint.

The compression strength is preferably at least approximately 10 mm Hg.

The proprioceptive stimulating effect of the stimulus-inducing structure is preferably achieved in that the stimulus-inducing structure comprises at least one stimulus-inducing functional element.

In preferred embodiments of the invention, the stimulus-inducing structure has a multiplicity of such functional elements.

The different functional elements of the stimulus-inducing structure can be isolated from one another or, particularly at end regions of the functional elements, adjoin one another.

Preferably, at least one functional element of a stimulus-inducing structure is configured as a raised portion.

The functional elements can be formed by attaching or working in materials or constructions to a base element, in particular a basic knit material of the upper body article of apparel, which result in a localised raised portion of the textile structure which is noticeable as a local pressure point when the upper body article of apparel is worn.

Preferably, the functional elements are fixedly attached directly to a textile material of the upper body article of apparel. By this means the stimulus-inducing structure can be optimally positioned on the upper body article of apparel.

In principle, all materials and designs which result in a local pressure point on the skin of the wearer of the upper body article of apparel are suitable for the formation of the functional elements.

In principle, this can involve both hard, compact materials made, for example, of wood, plastics of any type or metal, as well as soft, flexible, plastic materials, such as plastics based on silicone, polytetrafluoroethylene (PTFE) or polyurethane (PUR).

In a preferred embodiment of the invention, it is provided that at least one functional element contains an elastic polymer, a thermoplastic polymer (in particular a thermoplastic elastomer) and/or a thermosetting polymer.

In particular, it can be provided that at least one functional element contains a silicone, a polyurethane, a plastisol (in particular a PVC-based plastisol), a polyurethane-based polymer, a polytetrafluorethylene-based polymer and/or a thermoplastic elastomer.

Alternatively or additionally thereto, it can also be provided that at least one functional element is formed by a textile construction, for example, plush, a spacer fabric, a spacer knitted fabric or by a punctiform two-layered knitted fabric.

Alternatively or additionally thereto, it can also be provided that at least one functional element comprises a knitted region of the upper body article of apparel which, with regard to its knitted construction, differs from a knitted region of the upper body article of apparel adjoining the functional element.

It can be provided, for example, that the knitted region of the functional element is configured as a plush.

Alternatively thereto, it can be provided that the knitted region of the functional element is configured as a tuck stitch fabric.

In order to increase the mechanical strength and hardness of the functional element, it can be provided that the knitted region of the functional element contains a hot-melt adhesive thread.

A hot-melt adhesive thread of this type can comprise, for example, polyester and/or copolyamide, and can preferably be made substantially entirely of polyester and/or copolyamide.

The hot-melt adhesive material from which such a hot-melt adhesive thread is made can have, for example, a softening point of 50° C. or higher, in particular 80° C. or higher.

Following a knitting procedure, by means of which the respective functional element is created, the region of the upper body article of apparel in which the functional element has been created can be subjected to a heat treatment, by means of which the hot-melt adhesive material is heated to a temperature above its softening point.

The treatment temperature can be 70° C. or higher, in particular 100° C. or higher.

The higher the treatment temperature is selected to be, the more intimately the hot-melt adhesive material is connected to the other materials of the functional element and the harder the functional element thereby produced becomes.

The heat treatment can be performed, for example, by tumbling, form fixing or the application of hot air.

At least one functional element, preferably a plurality of functional elements, have a drop-shaped or napped form.

It is particularly favourable for the proprioceptive stimulating effect if the functional elements exert a localised pressure loading onto the skin of the wearer.

It is therefore favourable if at least one functional element of a stimulus-inducing structure is configured locally delimited, in particular substantially punctiform.

Preferably, all the functional elements of at least one stimulus-inducing structure, in particular all the functional elements of all the stimulus-inducing structures of the upper body article of apparel are configured locally delimited, in particular substantially punctiform.

It is particularly favourable if at least one functional element has a largest extent (along the base element of the upper body article of apparel) of not more than approximately 1.0 cm, preferably not more than approximately 0.7 cm, in particular not more than approximately 0.6 cm, particularly preferably not more than approximately 0.3 cm. It is particularly favourable if all the functional elements of a stimulus-inducing structure have such a greatest extent.

It has also proved to be favourable if at least one functional element has a largest extent (along the base element of the upper body article of apparel) of at least approximately 0.2 cm. It is particularly favourable if all the functional elements of a stimulus-inducing structure have such a greatest extent.

A functional element of a stimulus-inducing structure can have, for example, a substantially circular outer contour.

Each functional element, in particular each locally delimited functional element, however, can in principle also have any other outer contour, for example, a polygonal outer contour, a triangular outer contour, a square outer contour, a rectangular outer contour or an angular outer contour.

Locally delimited functional elements differ from linear elements which have a large extent in one dimension and from large area elements which have a large extent in two dimensions.

If functional elements of a stimulus-inducing structure, which are particularly in the form of web elements, adjoin one another at their end regions and thus form a coherent stimulus-inducing structure, such a stimulus-inducing structure can be configured, in particular, honeycomb-shaped.

For a local, isolated proprioceptive stimulation of the musculature of the wearer, it is of essential significance that between the functional elements of a stimulus-inducing structure which are configured, in particular, punctiform or linear, area sections that are free from the functional elements remain on the upper body article of apparel which, in the worn state of the upper body article of apparel, exert no pressure on the skin of the wearer.

The height of at least one functional element, that is, its extent perpendicular to the base element of the upper body article of apparel, by which the functional element projects toward the skin of the wearer, is at least approximately 0.1 cm, in particular at least approximately 0.2 cm.

It is also advantageous if the height of at least one functional element is not more than approximately 0.6 cm, preferably not more than approximately 0.4 cm, in particular not more than approximately 0.3 cm.

It has also proved to be favourable if the Shore A hardness of the material of at least one functional element is at least approximately 20, preferably at least approximately 30.

Preferably at least one functional element is made of a material with a Shore A hardness of not more than approximately 90.

The Shore A hardness can be determined according to DIN 53505 or DIN EN ISO 868.

Alternatively or additionally thereto, it can also be provided that at least one functional element is made of a material with a Shore D hardness of at least approximately 20.

The Shore D hardness is preferably not more than approximately 90.

The Shore D hardness can be determined according to DIN 53505 or DIN ISO 7619-1.

In a particular embodiment of the invention, it is provided that at least one functional element is fixed to a base element of the upper body article of apparel. Preferably, all the functional elements are fixed to the base element of the upper body article of apparel.

In particular, it can be provided that at least one functional element is fixedly connected directly to a textile material of the garment. By this means, the stimulus-inducing structure formed by the functional elements can be optimally positioned on the upper body article of apparel.

The application of functional elements which are not based on a textile construction onto the base element of the upper body article of apparel can be carried out, for example, by a printing method, for example, a stencil printing method or a silk screen method with subsequent thermal fixing of the functional elements to the base element of the upper body article of apparel.

Alternatively or in addition thereto, it can be provided that at least one stimulus-inducing structure comprises at least one support element on which a plurality of functional elements are provided.

In particular, it can be provided that the plurality of functional elements are formed integrally with the support element.

At least one support element can be non-releasably fastened to a base element of the upper body article of apparel.

Alternatively or in addition thereto, it can be provided that at least one support element is releasably connected to a base element of the upper body article of apparel.

A plurality of stimulus-inducing functional elements can be connected in a separate process to a coherent unit and this unit can be fixed to the base element of the upper body article of apparel, for example, by adhesion, welding or sewing.

The support element can be a pre-fabricated part which has a plurality of functional elements.

The support element can be formed, for example, as an injection moulded part.

A stimulus-inducing structure can be formed by a support element of this type or by a plurality of such support elements.

The outer contour of such a support element can correspond to the outer contour of an overall stimulus-inducing structure.

The support element can be formed, for example, as a film or a textile construction.

A support element which preferably comprises the stimulus-inducing functional elements of an overall stimulus-inducing structure and is preferably based on a textile construction can be connected flexibly and/or releasably to the base element of the upper body article of apparel by means of known manufacturing techniques.

The upper body article of apparel can be provided with markings differentiated by colour relative to a base material of the upper body article of apparel, which serve as an orientation aid for the wearer of the upper body article of apparel when putting on the upper body article of apparel, in order to achieve an optimum positioning of the stimulus-inducing structures on the body of the wearer.

Since the stimulating effect of the functional elements is based on a proprioceptive stimulation of muscles and tendons, the functional elements are preferably arranged in regions of the upper body article of apparel which, in the worn state of the upper body article of apparel, lie on regions of the body of the wearer with the greatest possible receptor density.

Particularly preferred herein are the muscle and tendon structures which are relevant according to physiological and medical criteria for posture and movement coordination.

The attachment of stimulus-inducing structures in the lower back region, in the region of the thoracolumbar fascia and along the erector spinae dorsal extensor muscle group parallel to the spinal column, preferably beginning from the coccyx to approximately the height of the thoracic vertebra identified as T 10 has proved to be particularly favourable for proprioceptive stimulation in the case, particularly, of a shirt-like upper body article of apparel with a trunk region.

A stimulus-inducing structure is preferably provided with an extent which results, in the worn state of the upper body article of apparel, in the greatest possible and optimum overlapping with the thoracolumbar fascia.

In one possible embodiment of such a stimulus-inducing region, the stimulus-inducing region, also referred to hereinafter as the stimulus induction zone, is configured as a right-angled quadrilateral, preferably with an edge length of at least approximately 8 cm.

Alternatively thereto, the stimulus induction zone can also have a different outer contour, for example, a circular outer contour or a polygonal outer contour with n angles (in particular where n=3 or 5 to 8).

It has also been found to be favourable to arrange to the left and right of the spinal column, parallel thereto, two strip-shaped stimulus-inducing regions or stimulus induction zones in such a way that these regions overlap the erector spinae muscle group as well as possible, particularly up to approximately the height of the T 10 vertebra.

It is particularly favourable if these strip-shaped stimulus induction zones directly adjoin, each with a narrow side, the stimulus induction zone which at least partially overlaps the thoracolumbar fascia.

The spacing of the stimulus induction zones extending parallel to the spinal column from one another is herein selected such that, in the worn state of the upper body article of apparel, overlapping with the vertebral spinous processes is prevented in order to prevent nerve irritation.

The strip-shaped stimulus induction zones preferably have a width of not more than approximately 6 cm, in particular not more than approximately 5 cm.

The spacing between the strip-shaped stimulus induction zones extending to the left and right of the spinal column parallel thereto and substantially parallel to one another is preferably at least approximately 1 cm and not more than approximately 4 cm.

In a preferred embodiment of the upper body article of apparel according to the invention, it is therefore provided that, in the worn state of the upper body article of apparel, at least one stimulus-inducing structure at least partially overlaps the thoracolumbar fascia of the wearer of the upper body article of apparel.

It is particularly favourable if, in the worn state of the upper body article of apparel, a stimulus-inducing structure substantially completely overlaps the thoracolumbar fascia.

Alternatively or additionally thereto, it can be provided that, in the worn state of the upper body article of apparel, at least one stimulus-inducing structure at least partially overlaps the erector spinae muscle group. In particular, it can be provided that an outer contour of at least one stimulus-inducing structure substantially corresponds to an outer contour of the erector spinae muscle group.

It is particularly favourable if at least one stimulus-inducing structure at least partially overlapping the erector spinae muscle group extends in the worn state of the upper body article of apparel to approximately the height of thoracic vertebra T 10.

If the upper body article of apparel comprises at least one arm region, it is advantageous if, in the worn state of the upper body article of apparel, at least one stimulus-inducing structure at least partially overlaps the triceps brachii muscles. In particular, it can be provided that an outer contour of at least one stimulus-inducing structure substantially corresponds to an outer contour of the triceps brachii muscles.

Alternatively or additionally thereto, it can be provided that, in the worn state of the upper body article of apparel, at least one stimulus-inducing structure at least partially overlaps the extensors of the forearm of the wearer. In particular, it can be provided that an outer contour of at least one stimulus-inducing structure substantially corresponds to an outer contour of the extensors of the forearm of the wearer.

In order to enhance the wearing comfort and to prevent a possible risk of irritations and nerve stimulation, it is preferably provided that, in the worn state of the upper body article of apparel, the thoracic region, the spinous processes of the vertebral column and/or the neck region of the wearer of the upper body article of apparel are not in contact with a stimulus-inducing structure of the upper body article of apparel.

All the stimulus-inducing structures described above with regard to their positioning bring about a proprioceptive stimulation of the respective wholly or partially overlapped muscles or fibrous structures.

By means of the proprioceptive stimulation, an improved synchronisation of the muscles recruited for a movement is achieved.

In order to achieve a selective proprioceptive stimulation and to prevent potential faulty stimulation, it is favourable if the upper body article of apparel has at least two stimulus-inducing structures which are separated from one another by a region without any stimulus-inducing structure.

In a preferred embodiment of the upper body article of apparel according to the invention, it is provided that the stimulus induction zones in which the stimulus-inducing structures are arranged cover not more than half, preferably not more than a third, in particular not more than a quarter of the inside surface of the upper body article of apparel facing the body of the wearer in the worn state of the upper body article of apparel.

It is also favourable if at least one stimulus-inducing structure is arranged outside border regions of the upper body article of apparel.

In order to make the position of the stimulus-inducing structures visible from the outside of the upper body article of apparel, it can be provided that at least one stimulus-inducing structure is arranged in a stimulus induction zone which is edged at least partially by a bordering strip.

A bordering strip of this type can stand out from the base element, in particular, by means of a colour contrasting with the colour of the base element of the upper body article of apparel.

Furthermore, the upper body article of apparel is preferably provided with a marking which serves as a positioning aid for positioning at least one stimulus-inducing structure of the upper body article of apparel relative to the body of the wearer during putting on of the upper body article of apparel. By this means, the most accurate possible positioning of the stimulus-inducing structures relative to the body of the wearer when the upper body article of apparel is worn can be achieved.

A marking of this type can be distinct particularly as regards colour from a base material of the upper body article of apparel.

At least one stimulus-inducing structure of the upper body article of apparel according to the invention is preferably configured substantially as a strip.

It can also be provided that such a strip-shaped stimulus-inducing structure has a width (that is, an extent perpendicular to its longitudinal extent) of not more than approximately 4 cm, in particular not more than approximately 2 cm.

The stimulus-inducing structure is preferably fixedly attached to a base element, in particular a ground fabric of the upper body article of apparel.

The surface density of the functional elements within a stimulus-inducing structure of the upper body article of apparel is preferably at least approximately 1 per $cm^2$, in particular at least approximately 4 per $cm^2$, particularly preferably at least approximately 8 per $cm^2$.

Furthermore, the surface density of the functional elements within a stimulus-inducing structure is preferably not more than approximately 25 per $cm^2$, in particular not more than approximately 16 per $cm^2$, particularly preferably not more than approximately 12 per $cm^2$.

By means of the above-mentioned preferred embodiments of the functional elements and the stimulus-inducing structure, both the efficiency of the stimulating effect and the wearing comfort for the wearer are taken into account.

Further features and advantages of the invention are the subject matter of the following description and of the illustration in the drawings of an exemplary embodiment.

The same or functionally equivalent elements are provided in all the drawings with the same reference signs.

DETAILED DESCRIPTION OF THE INVENTION

Figure 1:
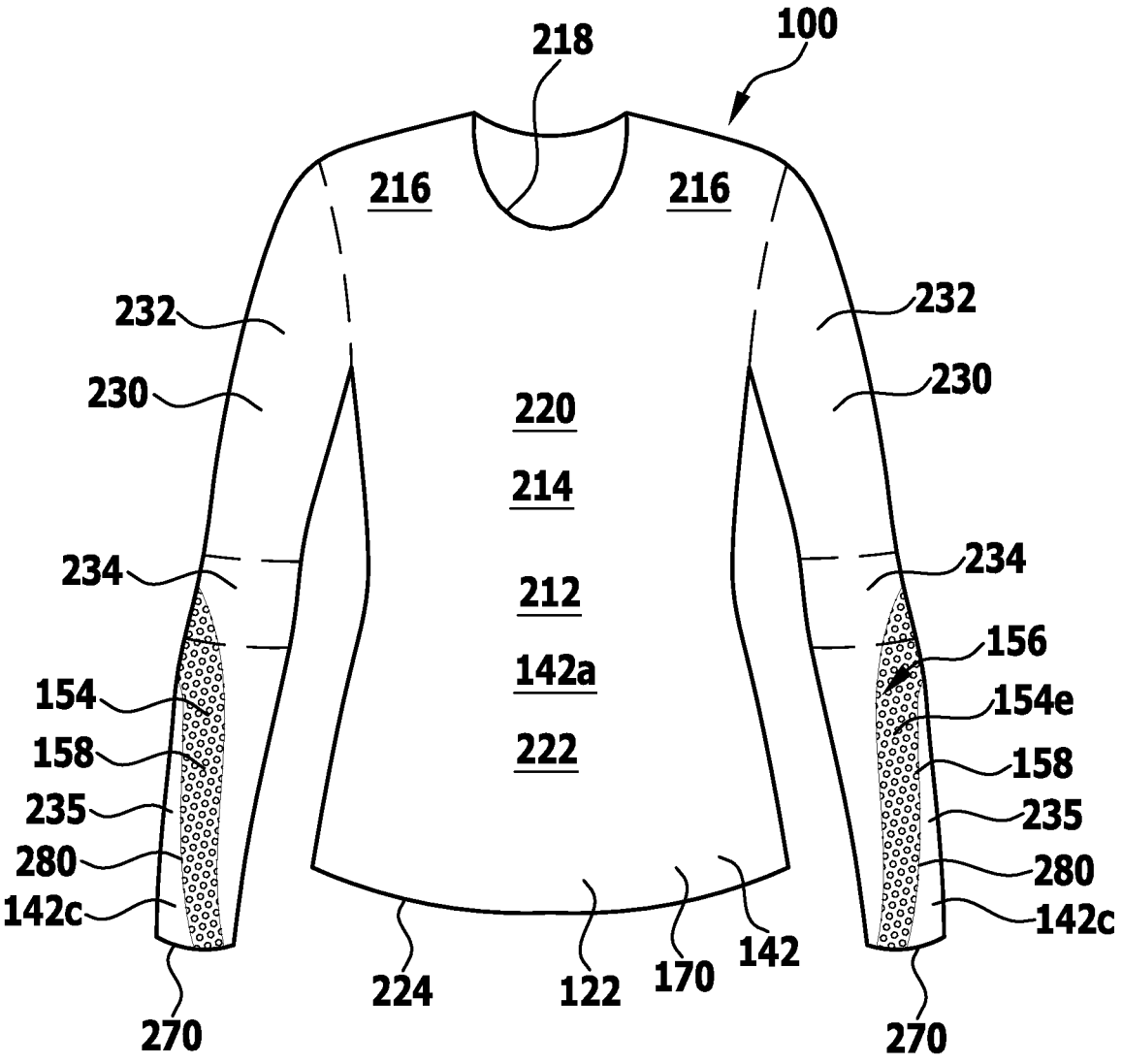
FIG. 1 shows a schematic front view of an upper body article of apparel with compression regions and stimulus induction zones.
Figure 2:
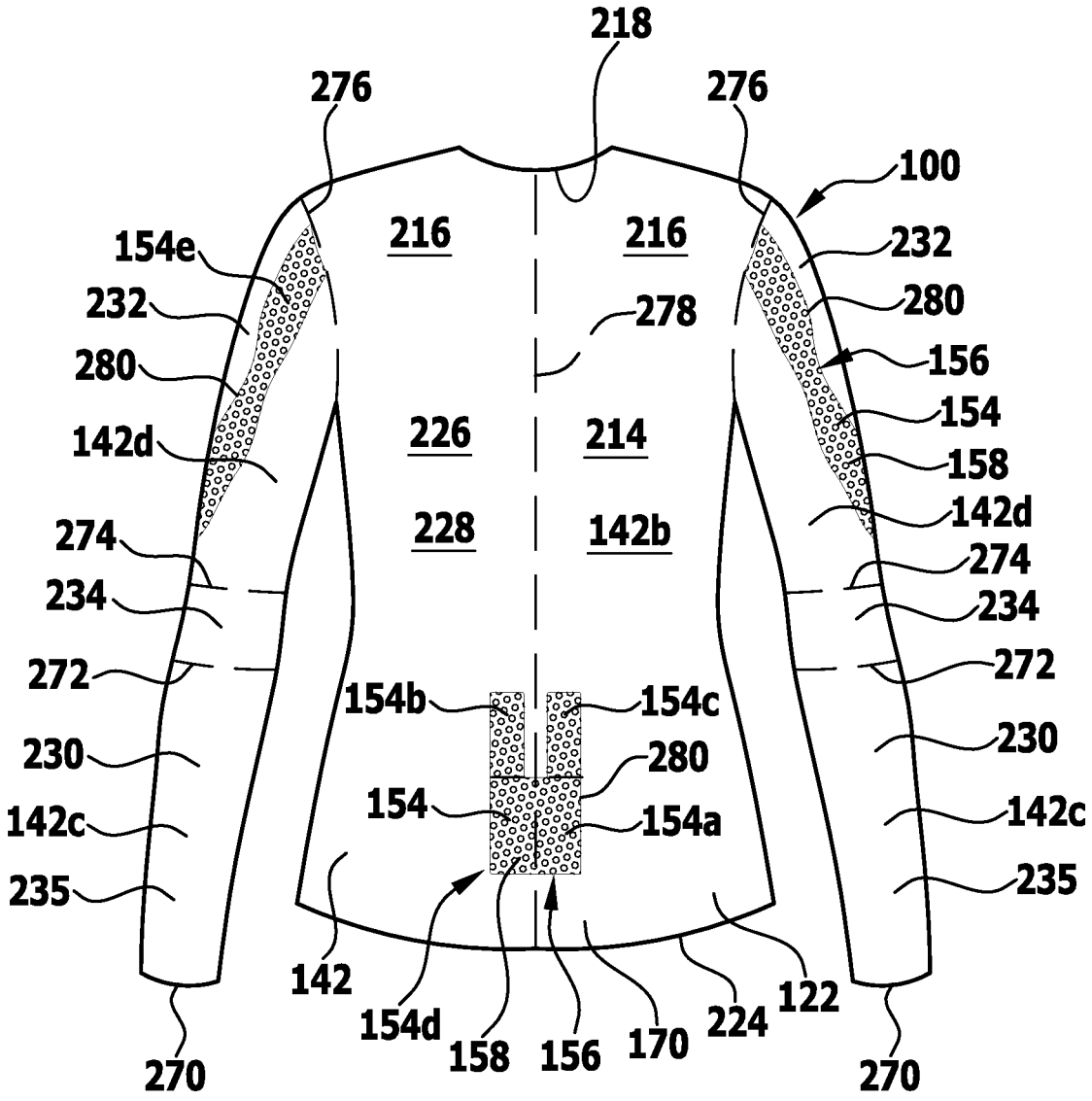
FIG. 2 shows a schematic rear view of the upper body article of apparel of FIG. 1.

An upper body article of apparel shown in FIGS. 1 and 2 configured, by way of example, as a shirt 100 is shown in FIG. 1 from the front and in FIG. 2 from the rear and comprises a trunk region 214, the front side 212 of which extends from two shoulder regions 216 and a collar 218 arranged therebetween downwardly via a chest region 220 and an abdominal region 222 to a lower border 224 (see FIG. 1).

A rear side 226 of the trunk region 214 (see FIG. 2) extends from the shoulder regions 216 and the collar 218 downwardly over a back region 228 to the lower border 224 of the shirt 100.

An arm region 230 of the shirt 100 is fixed to each of the shoulder regions 216 of the trunk region 214.

Each arm region 230 comprises an upper arm region 232, an elbow region 234 in the region of the elbow joint and a forearm region 235.

The shirt 100 also has one or more compression regions 142 in which, in the worn state, the shirt 100 exerts a compression effect on the body of the wearer.

This compression effect can be achieved, in particular, through the working in of one or more elastic threads into the basic knit material of the shirt 100.

The elastic thread(s) can, in particular, comprise elastane.

In particular the shirt 100 can have, at the front side 212 of the trunk region 214, a first compression region 142*a* which extends from the lower border 224 upwardly into the shoulder regions 216 and to the collar 218 of the shirt 100.

Furthermore, the shirt 100 can have, at the rear side 226 of the trunk region 214, a second compression region 142*b* which extends from the lower border 224 via the back region 228 into the shoulder regions 216 and the collar 218 of the shirt 100.

Furthermore, the shirt 100 can have a third compression region 142*c* on each arm region 230, extending from a lower border 270 of each arm region 230 upwardly as far as an upper edge 272 of the third compression region 142*c* which preferably extends below the elbow region 234 of each arm region 230.

Finally, the shirt 100 can have a fourth compression region 142*d* on each arm region 230, extending from a lower edge 274 of the fourth compression region 142*d* upwardly as far as an upper edge 276 of each arm region 230, at which the arm region 230 borders on the trunk region 214 of the shirt 100.

The lower edge 274 of the fourth compression region 142*d* preferably runs above each elbow region 234.

In the exemplary embodiment shown in FIGS. 1 and 2, the lower edge 274 of the fourth compression region 142*d* and the upper edge 272 of the third compression region 142*c* are separated from one another.

It could, however, also be provided that the compression regions 142*c* and 142*d* directly adjoin one another and form a coherent compression region of the respective arm region 230 of the shirt 100.

In principle, the progression of the compression strength in the compression regions 142*a* to 142*d* can be substantially constant.

In a preferred embodiment, however, a gradual progression of the compression strength in the compression regions 142*a* to 142*d* is provided.

The gradient of the compression strength is herein directed such that the compression strength both in the trunk region 214 and in the arm regions 230 always decreases in the direction toward the chest region 220.

In the first compression region 142*a* on the front side 212 of the trunk region 214 of the shirt 100, the relative compression strength in the chest region 220 is from zero to approximately 30% of the maximum compression strength in the first compression region 142*a* and in the shoulder regions 216 is from zero to approximately 60% of the maximum compression strength in the first compression region 142*a*.

The maximum compression strength in the first compression region 142*a* is preferably not more than approximately 12 mm Hg.

In the second compression region 142*b* on the rear side 226 of the trunk region 214, the relative compression strength in the part of the back region 228 lying opposite the chest region 220 is preferably from zero to approximately 30% of the maximum compression strength in the second compression region 142*b* and in the shoulder regions 216 is preferably from zero to approximately 60% of the maximum compression strength in the second compression region 142*b*.

The maximum compression strength in the second compression region 142*b* is preferably not more than approximately 12 mm Hg.

In the third compression regions 142*c*, the compression strength preferably decreases from the lower border 270 to the upper edge 272.

Furthermore, in the fourth compression regions 142*d*, the compression strength preferably decreases from the lower edge 274 to the upper edge 276.

In the elbow regions 234, the arm regions 230 preferably have no compression effect.

At the upper edge 276 of the arm regions 230, the compression strength is preferably substantially the same as in the shoulder regions 216 of the trunk region 214.

The arm regions 230 of the shirt 100 are preferably fixedly attached to the trunk region 214.

The arm regions 230 can have any desired length up to a full arm length.

Preferably, the trunk region 214 and the arm regions 230 are made of an elastically yielding material.

In particular, a base element 170 of the shirt 100 can be made of an elastic base material, preferably a knitted fabric.

The yarns and threads used for manufacturing the shirt 100 can be of natural as well as of synthetic origin. The use of a combination of natural and synthetic fibrous materials is also possible.

In particular, all single jersey basic structures are possible as knitted constructions for the basic knit material 122 of the base element 170 of the shirt 100, for example single jersey—unplated;
single jersey—plated (RL-p);
single jersey—tuck (RL-F);
single jersey—knop (RL-N);
single jersey—terry (RL-P); and
single jersey—floated (RL-h).

Each stimulus-inducing structure 156 comprises functional elements 158 which, in the worn state of the shirt 100, bring about a sensory stimulus effect and a proprioceptive stimulation of the musculature of the wearer.

This stimulation leads to increased muscle activity and improves the synchronisation of the wearer.

The functional elements 158 are preferably configured as raised portions which are arranged on the inside of the shirt 100 and act directly on the skin of the wearer.

Particularly thermoplastic or thermosetting polymers, which can optionally contain additives, are suitable as a material for the raised portions.

Silicones and PVC-based plastisols have proved to be particularly suitable.

Functional elements 158 made of such materials can be applied, for example, by a printing method, in particular by a stencil printing method or a silk screen printing method, onto the inside of the basic knit material 122 of the shirt 100.

Alternatively or additionally, the functional elements 158 can be made particularly in the form of raised portions, but also with textile materials and/or textile constructions, which lead to the formation of a raised portion, for example by means of a plush configuration, projecting toward the skin of the wearer.

In order to achieve an effective proprioceptive stimulation of the musculature of the wearer, it is favourable if the stimulation takes place locally limited, in particular substantially in point form.

It is therefore favourable if the functional elements 158 have a largest extent of not more than approximately 1.0 cm, preferably not more than approximately 0.6 cm, in particular not more than approximately 0.3 cm.

On the other hand, it has proved to be favourable if the largest extent of the functional elements 158 is at least approximately 0.2 cm.

The height of the functional elements 158, that is, their extent perpendicularly to the basic knit material 122 by which the functional elements 158 project toward the skin of the wearer, is at least approximately 0.1 cm, in particular at least approximately 0.2 cm.

It has also proved to be favourable if the height of the functional elements 158 is not more than approximately 0.6 cm, in particular not more than approximately 0.4 cm.

Preferably, the functional elements 158 are made of a material with a Shore A hardness of at least approximately 20.

It has also proved to be favourable if the Shore A hardness of the material of the functional elements 158 is not more than approximately 90.

The Shore A hardness can be determined according to DIN 53505 or DIN EN ISO 868.

Alternatively, the functional elements 158 can be made of a material with a Shore D hardness of at least approximately 20 and/or not more than approximately 90.

The Shore D hardness can be determined according to DIN 53505 or DIN ISO 7619-1.

Since the stimulation effect of the stimulus induction zones 154 involves a proprioceptives stimulation of the muscle and tendon structures, the stimulus-inducing structures 156 are preferably arranged in stimulus induction zones 154 along the courses of the muscles and/or the tendons.

Each stimulus-inducing structure 156 comprises functional elements 158 which, in the worn state of the shirt 100, bring about a sensory stimulus effect and a proprioceptive stimulation of the musculature of the wearer.

In particular, the functional elements 158 are preferably configured as raised portions arranged on the inside of the shirt 100, so that they can act directly on the skin of the wearer.

For example, at the back side 226 of the trunk region 214, in the lower back region 228 of the second compression region 142*b*, the shirt 100 can have a stimulus induction zone 154*a*, which substantially completely covers the thoracolumbar fascia of the wearer in the worn state of the upper body article of apparel.

The stimulus induction zone 154*a* is preferably configured as a rectangle with a width (extent parallel to the lower border 224) of approximately 10 cm to approximately 15 cm and a height (extent along the spinal column line 278 which, in the worn state of the shirt 100, follows the course of the spinal column of the wearer) of approximately 8 cm to approximately 15 cm.

The outer contour 280 of the stimulus induction zone 154*a* is preferably substantially configured and oriented with mirror symmetry to the spinal column line 278, which in the worn state of the shirt 100 corresponds to the position of the spinal column of the wearer.

In order to enable the most exact possible positioning of the stimulus induction zones 154 of the shirt 100 relative to the body of the wearer when the shirt 100 is put on, it can be provided that the spinal column line 278 is configured as a marking strip or a marking line on the shirt 100, which extends from the lower border 224 to the collar 218 and, when the shirt 100 is put on, can serve as a positioning aid for the wearer.

Two further stimulus induction zones 154*b* and 154*c* can be arranged to the left and right of the spinal column line 278, parallel thereto, and preferably such that the stimulus induction zones 154*b* and 154*c* in the form of strips directly adjoin the stimulus induction zone 154*a* at their lower edge, each with a narrow side, and extend upwardly to approximately the height of the vertebra T 10, in order thus to overlap the erector spinae muscle group as completely as possible.

The spacing of the stimulus induction zones 154*b* and 154*c* from one another perpendicular to the spinal column line 278 is preferably at least 1 cm and preferably not more than 4 cm. It is thereby achieved that, in the worn state of the shirt 100, overlapping of the stimulus induction zones 154*b* and 154*c* with the processes of the spinal column is largely avoided to preclude nerve irritation.

The width of the stimulus induction zones 154*b* and 154*c* themselves, that is their extent parallel to the lower border 224, is preferably from approximately 4 cm to approximately 6 cm.

The extent of the stimulus induction zones 154*b* and 154*c* along the spinal column line 278 is preferably from approximately 7 cm to approximately 17 cm.

The stimulus induction zones 154*a*, 154*b* and 154*c* which directly adjoin one another, together form a combined stimulus induction zone 154*d*, the overall extent of which parallel to the spinal column line 278 is preferably from approximately 20 cm to approximately 25 cm.

Furthermore, the shirt 100 can have a stimulus induction zone 154*e* in each of the arm regions 230, extending from the lower border 270 of each arm region 230 via the forearm region 235, the elbow region 234 and the upper arm region 232 as far as the upper edge 276 of the each arm region 230.

These stimulus induction zones 145*e* preferably extend along the triceps brachii muscles and along the extensors of the forearm when the shirt 100 is worn.

Preferably, the outer contours 280 of the stimulus induction zones 154*e* substantially correspond to the outer contours of the triceps brachii muscles and/or the extensors of the forearm.

The width of the stimulus induction zones 154, that is, their extent in the peripheral direction of the shirt 100 is preferably dimensioned so that the individual anatomical differences of the different wearers are taken into account.

Since the functional elements 158 of the stimulus induction zones 154 are arranged on the inside of the shirt 100, they do not have to be visible from the outside of the shirt 100 (as shown in FIGS. 1 and 2).

In order that the stimulus-inducing structures 156 of the stimulus induction zones 154 can have the strongest possible stimulating effect on the respective associated muscle and tendon structures, the stimulus induction zones 154 should be positioned, in the worn state, as precisely as possible on the respectively associated muscle and tendon structures.

As shown in FIGS. 1 and 2, the stimulus-inducing structures 156 of the stimulus induction zones 154 are mostly arranged, preferably by more than 90%, in one of the compression regions 142 of the shirt 100. By this means, it is achieved that the local pressure loading of the skin of the wearer is amplified by the functional elements 158 of the stimulus-inducing structures 156 by the large area compression effect of the compression regions 142. Thus, by means of the combination of the compression effect, firstly, of the compression regions 142 and, secondly, of the local functional elements 158 of the stimulus-inducing structures 156, a particularly effective proprioceptive stimulation of the musculature of the wearer is brought about.

The surface density of the functional elements 158 in the stimulus induction zones 154 is preferably at least approximately 1 per $cm^2$, in particular at least approximately 4 per $cm^2$, particularly preferably at least approximately 8 per $cm^2$.

It has further proved to be favourable if the surface density of the functional elements 158 in the stimulus induction zones 154 is not more than approximately 25 per $cm^2$, in particular not more than approximately 16 per $cm^2$, particularly preferably not more than approximately 12 per $cm^2$.

In FIGS. 1 and 2, the functional elements 158 of the stimulus-inducing structures 156 are shown schematically as substantially circular.

Figure 3:
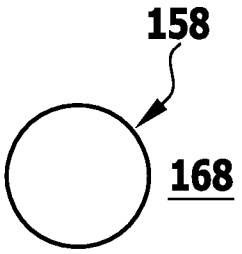
FIG. 3 shows a schematic representation of a circular functional element of a stimulus-inducing structure.

A single functional element 158 with a circular edge is shown in FIG. 3.

Figure 4:
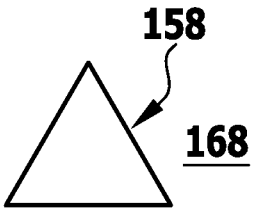
FIG. 4 shows a schematic plan view of a triangular functional element of a stimulus-inducing structure.
Figure 5:
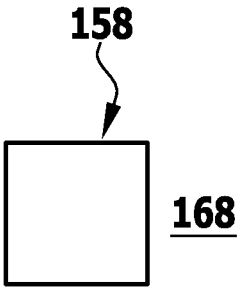
FIG. 5 shows a schematic plan view of a square functional element of a stimulus-inducing structure.
Figure 6:
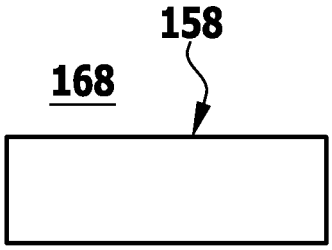
FIG. 6 shows a schematic plan view of a rectangular functional element of a stimulus-inducing structure.
Figure 7:
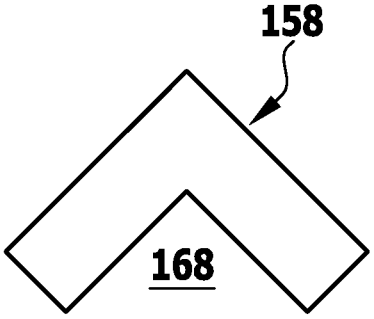
FIG. 7 shows a schematic plan view of an angular functional element of a stimulus-inducing structure.

The functional elements 158 can, in principle, also have any desired other outer contours, for example, a triangular outer contour (see FIG. 4), a square outer contour (see FIG. 5), a rectangular outer contour (see FIG. 6) or an angled outer contour (see FIG. 7).

Figure 8:
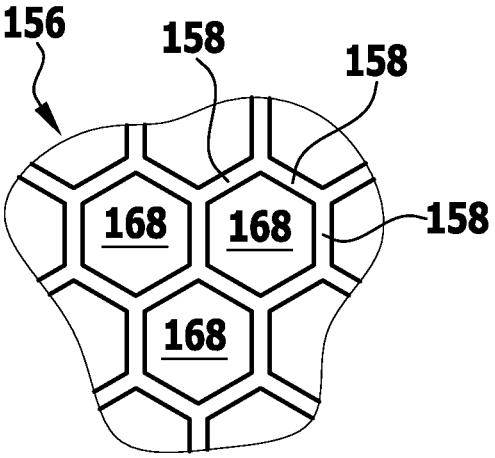
FIG. 8 shows a schematic plan view of a portion of a stimulus-inducing structure in the form of a honeycomb.

Furthermore, it can be provided that the functional elements 158 of a stimulus-inducing structure 156 are not entirely isolated from one another, but rather adjoin one another at end points and thus form a coherent stimulus-inducing structure 156, for example a stimulus-inducing structure 156 in the form of a honeycomb, as shown as a section in FIG. 8.

For a local, isolated proprioceptive stimulation of the musculature of the wearer, however, it is important that the functional elements 158 do not cover the whole area of the respective stimulus induction zone 154, but that surface sections 168 free from the functional elements 158 remain between the functional elements 158 and, in the worn state of the shirt 100, do not exert any pressure on the skin of the wearer.

In an upper body article of apparel which comprises a textile base element 170 in the form of a basic knit material 172, the functional elements 158 of the stimulus-inducing structures 156 can be formed, in particular, in that the relevant functional element 158 comprises a knitted region 174 which differs in its construction from an adjoining knitted region 176 of the basic knit material 172.

Figure 9:
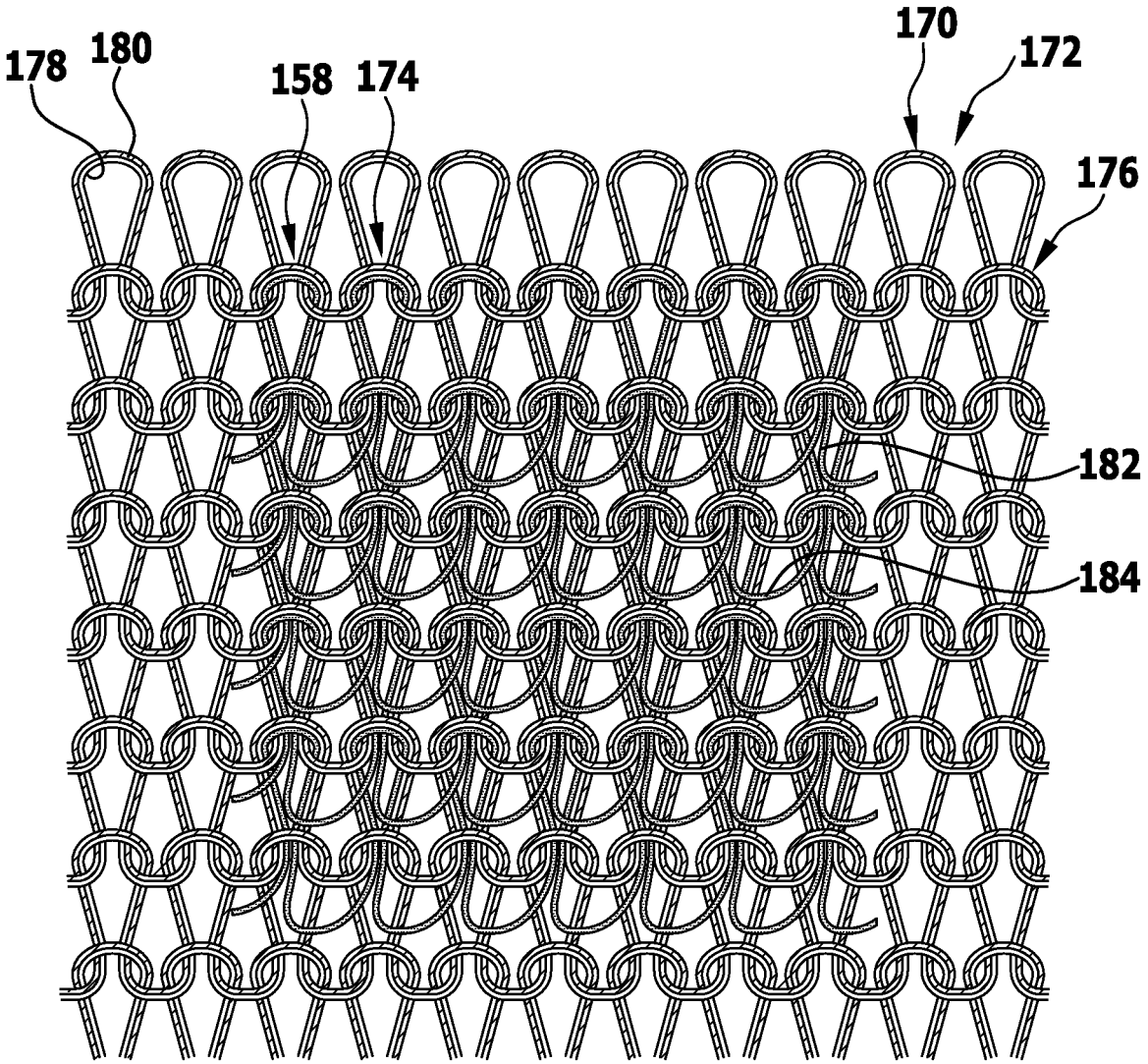
FIG. 9 shows a schematic stitch structure of a knitted surface with a knitted-in functional element in the form of plush.

Thus, in the functional element 158 shown schematically in its stitch structure in FIG. 9, the knitted region 176 of the basic knit material 172 adjoining the functional element 158 is knitted in a single jersey basic structure made of a ground thread 178 (shown in FIG. 9 without shading), which is plaited with a plaiting thread 180 (shown in FIG. 9 with shading).

In the knitted region 174 of the functional element 158 (shown centrally in FIG. 9) which in the exemplary embodiment shown comprises seven stitch wales and six stitch rows, an additional plush thread 182 (shown dotted in FIG. 9) is knitted into the basic knit material 172 with a plush structure.

The knitted region 174 of the functional element 158 is therefore selectively configured as a plush (sandwich or normal plush).

This plush forms a structure raised above the basic knit material 172.

The plush can be knitted with an ergonomic method (plated in shapes) or selectively knitted.

The shape of the knitted region 174 is, in principle, arbitrary; in particular, any of the outer contours shown in FIGS. 3 to 8 can be used for this.

Each functional element 158 which comprises a knitted region 174 with a raised area is knitted separately from the other functional elements 158 by means of the plush thread 182 introduced additionally from a basic system of the knitting machine or from one or more knitting systems of the knitting machine, which forms stitches together with the basic knit material 172.

Whilst the ground thread 178 and the plaiting thread 180 produce smooth stitches, ground stitches are created from the additional plush threads 182 with inwardly facing (that is, in the worn state of the upper body article of apparel, toward the skin of the wearer) plush loops 184.

The additional plush thread 182 is introduced into an area which can be freely determined using a pattern and cut, for example, by means of a saw and a top blade of the knitting machine, so that individual functional elements 158 arranged separately from one another are produced.

Figure 10:
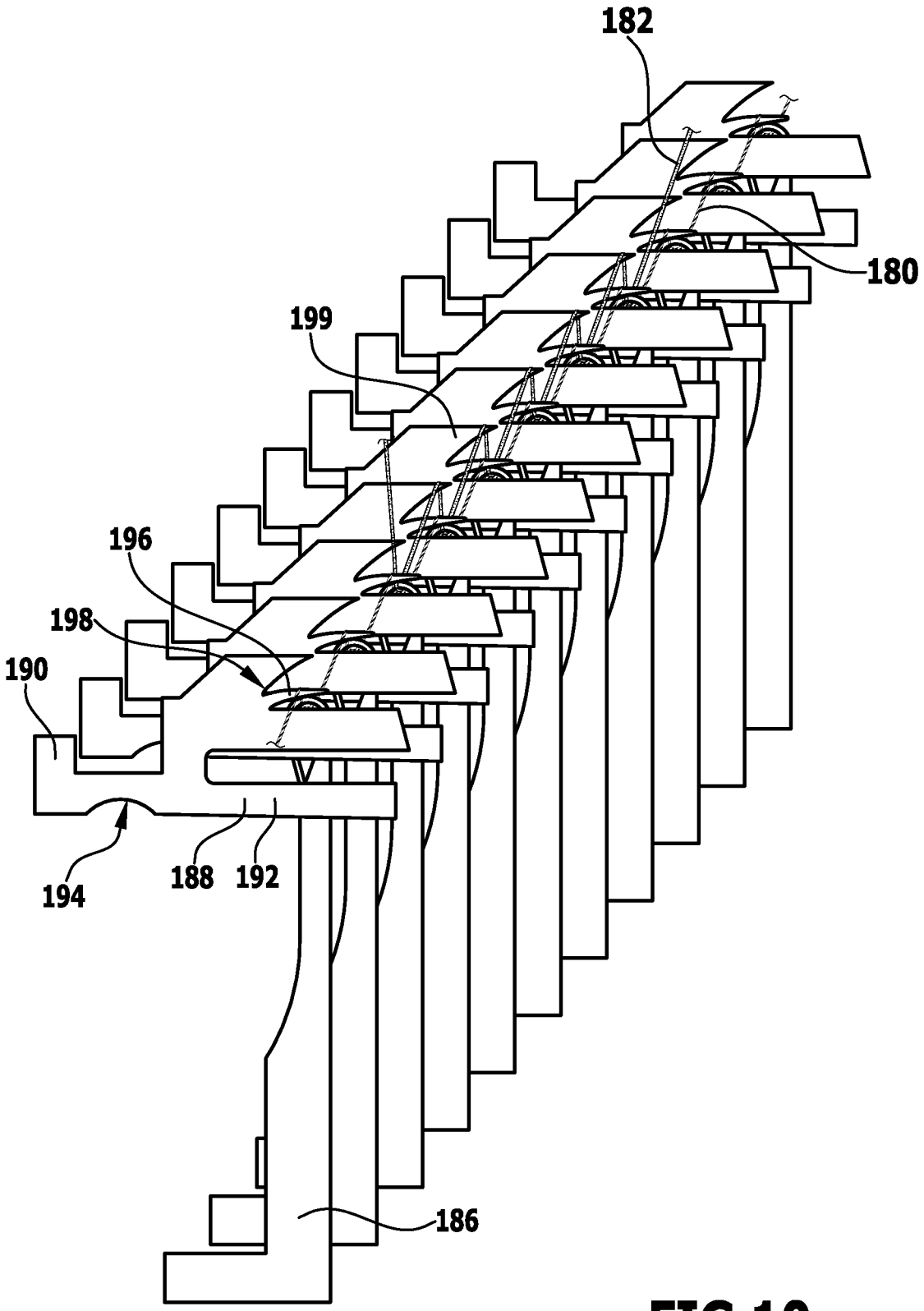
FIG. 10 shows a perspective view of sandwich plush sinkers of a knitting machine.

For manufacturing a selective plush or partial plush of this type, a knitting machine which has needles 186 and plush sinkers 188 can be used, as illustrated schematically in FIG. 10.

The plush sinkers 188 shown in FIG. 10 are sandwich plush sinkers. Alternatively thereto, however, other knocking-over sinkers, in particular, normal plush sinkers can be used.

Each of the plush sinkers 188 has a foot 190, a shaft 192, a forward guide part 194 arranged between the shaft 192 and the foot 190, a sinker beak 196 arranged above the shaft, a throat 198 arranged above the sinker beak 196 and a plush nib 199 arranged above the throat.

The course of the plaiting thread 180 and of the plush thread 182 over the plush sinkers 188 and the needles 186 is also shown in FIG. 10. The ground thread 178 runs directly under the plaiting thread 180 and in the representation in FIG. 10 is covered by the plaiting thread 180.

Through the use of sandwich plush sinkers, the plush thread 182 is brought to the outside of the fabric.

Any desired materials and material combinations can be used as the ground thread 178 and the plaiting thread 180 of the basic knit material 172.

Preferably, for the formation of the plush in the knitted region 174 of the functional element 158, there is used a synthetic fibre material made, for example, of polypropylene in combination with a hot-melt adhesive material made, for example, of polyester.

In an actual exemplary embodiment, a polyproylene filament yarn (for example, a twisted dtex 84/F25/2 yarn, made of 2 threads of 25 filaments each) with a relatively low melting point in the region of 165° C. to approximately 175° C. and a softening point in the region of 150° C. to 155° C. is combined with the hot-melt adhesive material PES Grilon KE 60 with a softening point in the range of 55° C. to 65° C. and a usage temperature of 80° C. to 110° C.

The combination of these materials forming the plush thread 182 can be made, for example, by intermingling or entwining.

A twisting process is less favoured in order to obtain extensive neutrality in the twisting tendency.

The thread construction forming the plush thread 182 can be very readily used in the stitch forming process of the knitting process due to its retained softness.

Only by means of a subsequent heat treatment following the knitting process at a temperature in the range of approximately 105° C. to approximately 180° C. does melting of the materials take place in the knitted region 174 of the functional element 158, leading to the formation of stiffened, relatively hard structures which cause the stimulating effect when the upper body article of apparel is worn.

The hardness of the functional elements 158 made in this way can be influenced, for example, by the selection of the treatment temperature during the heat treatment.

A higher treatment temperature leads, in principle, to a higher level of hardness of the functional elements 158, since a larger proportion of the hot-melt adhesive material is melted and binds to the other materials in the knitted region 174 of the functional element 158, so that the functional element 158 becomes stiffer.

The heat treatment can be performed after knitting the knitted region 174 of the functional element 158, for example, by tumbling, form fixing, or by applying hot air.

Figure 11:
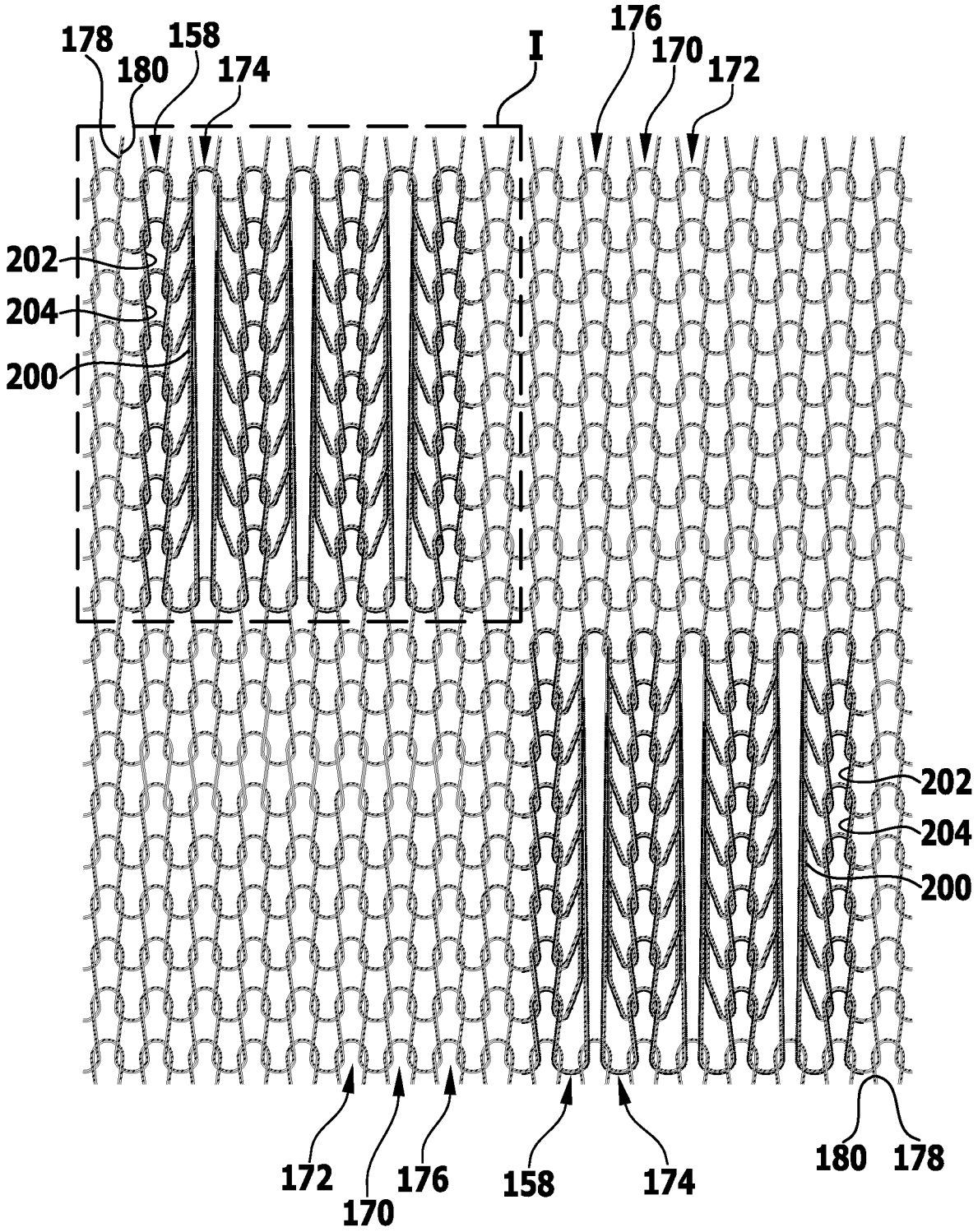
FIG. 11 shows a schematic stitch structure of a knitted surface with two functional elements configured as tuck stitch fabric.
Figure 12:
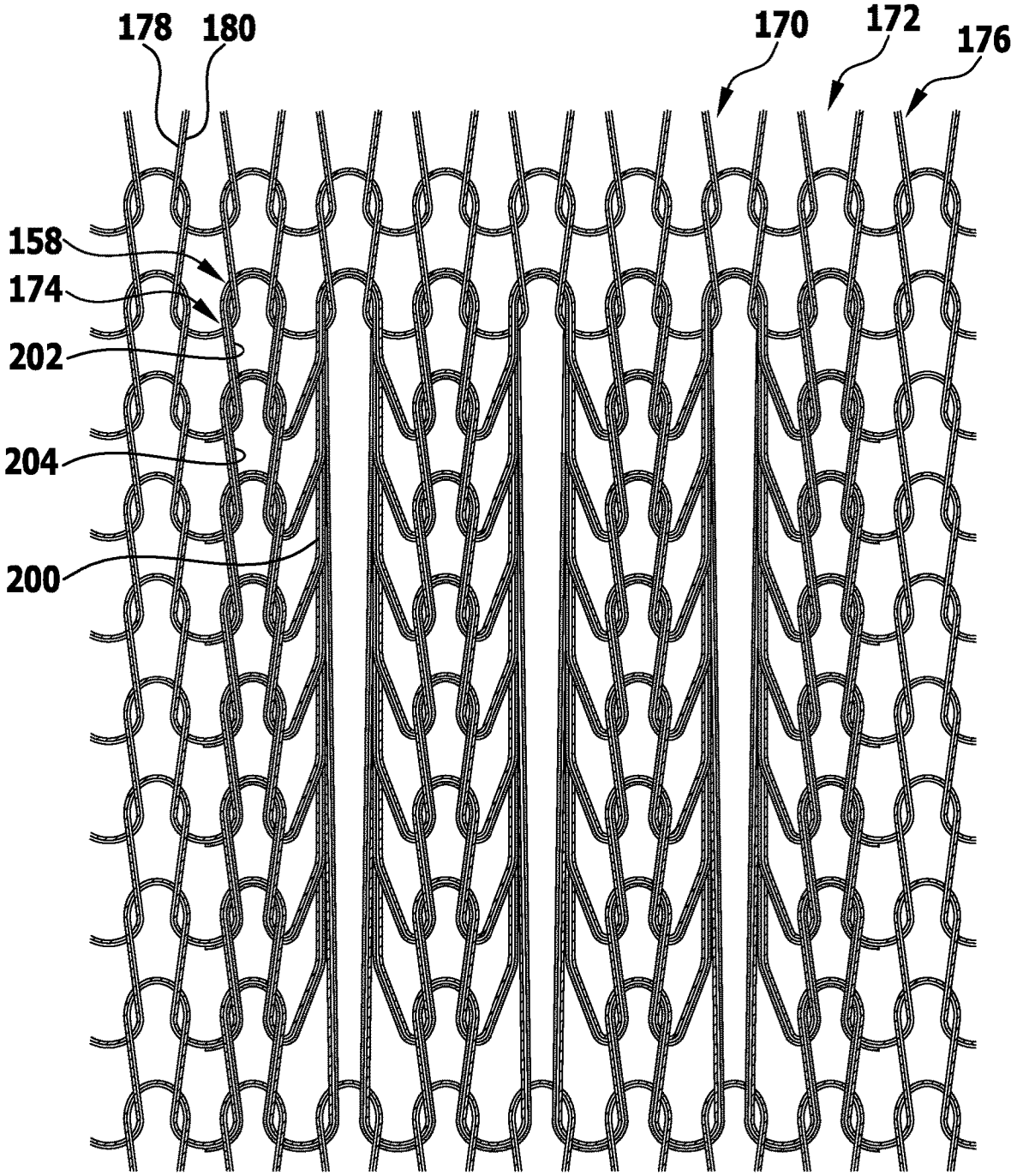
FIG. 12 shows an enlarged representation of the region I of FIG. 11.

Another possibility for creating functional elements 158 by generating a knitted region 174 which, with respect to its weave, differs from an adjoining knitted region 176 of a basic knit material 172 of the upper body article of apparel is shown schematically in the stitch structures of FIGS. 11 and 12, wherein FIG. 12 is an enlarged section of the region I of the fabric, shown at top left in FIG. 11.

In this embodiment also, the basic knit material 172 is formed from a ground thread 178 (shown without shading in FIGS. 11 and 12) and a plaiting thread 180 (shown with shading in FIGS. 11 and 12).

A functional element 158 in the form of a region which is raised relative to the basic knit material 172 is obtained in this embodiment in that a tuck stitch fabric is created which comprises a plurality of tuck stitch loops 200 over a plurality of, in the exemplary embodiment shown eight, stitch rows and with a repeat of a plurality of, in the exemplary embodiment shown, six, stitch wales in a single jersey knitted fabric.

In the knitted region 174 of the functional element 158, a hot-melt adhesive thread 204 (shown dotted in FIGS. 11 and 12) can be worked in by plaiting as an additional plaiting thread 202.

A hot-melt adhesive thread 204 of this type can comprise, for example, polyester or copolyamide.

For example, the hot-melt adhesive material PES Grilon KE 60 made of polyester (with a softening point of 55° C. to 65° C.) or the hot-melt adhesive material Grilon KE 85 Copolyamide made of copolyamide with a softening point of 80° C. to 90° C. can be used as the hot-melt adhesive thread 204.

Any desired materials and material combinations can be used as the ground thread 178 and the plaiting thread 180 for the basic knit material 172.

In an actual exemplary embodiment, the elastic covering material CT 6416 consisting of an elastane thread with a fineness of dtex 17 covered with a polyamide thread having a dtex of 16F10 is used as the ground thread 178 and a polyamide yarn with a dtex of 78/68/2 is used as the plaiting thread 180.

When the knitted region 174 of the functional element 158 is knitted, the ground thread 178, the plaiting thread 180 and the hot-melt adhesive thread 204 are floated to form the tuck stitch loops 200 during the formation of a plurality of, for example eight, stitch rows and are then cast off.

In FIG. 11, two functional elements 158 made in this way are shown, offset to one another in a diagonal direction of the fabric.

A variety of possibilities as to how the functional elements 158 of the stimulus-inducing structures 156 in the stimulus induction zones 154 of an upper body article of apparel can be produced directly on a base element 170 of the upper body article of apparel have been described above.

Alternatively thereto, at least one stimulus-inducing structure 156 can comprise at least one support element 236 (see FIG. 13) on which a plurality of functional elements 158 are provided.

The support element 236 having the functional elements 158 can be manufactured separately from the base element 170 of the upper body article of apparel and then releasably or non-releasably connected to the base element 170 of the upper body article of apparel.

In a particular embodiment of such a support element 236, it is provided that all the functional elements 158 of a stimulus induction zone 154 are arranged on the relevant support element 236, so that for manufacturing the stimulus-inducing structure 156 of the respective stimulus induction zone 154, only a single support element 158 is needed.

In such a case, an outer contour 238 of the support element 236 preferably substantially matches the outer contour 280 of the associated stimulus induction zone 154.

Figure 13:
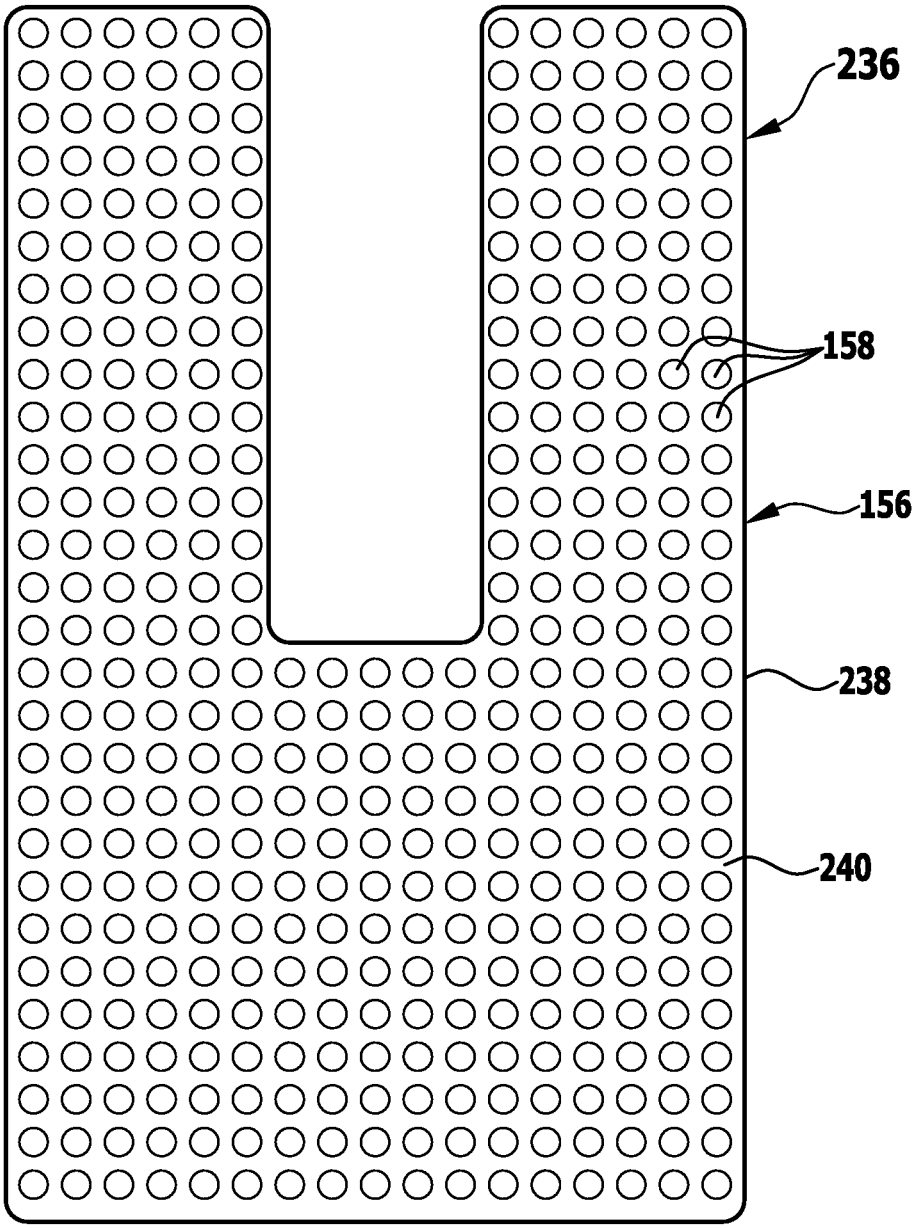
FIG. 13 shows a schematic plan view of a front side of a support element of a stimulus-inducing structure, the support element being provided with a plurality of stimulus-inducing functional elements.
Figure 14:
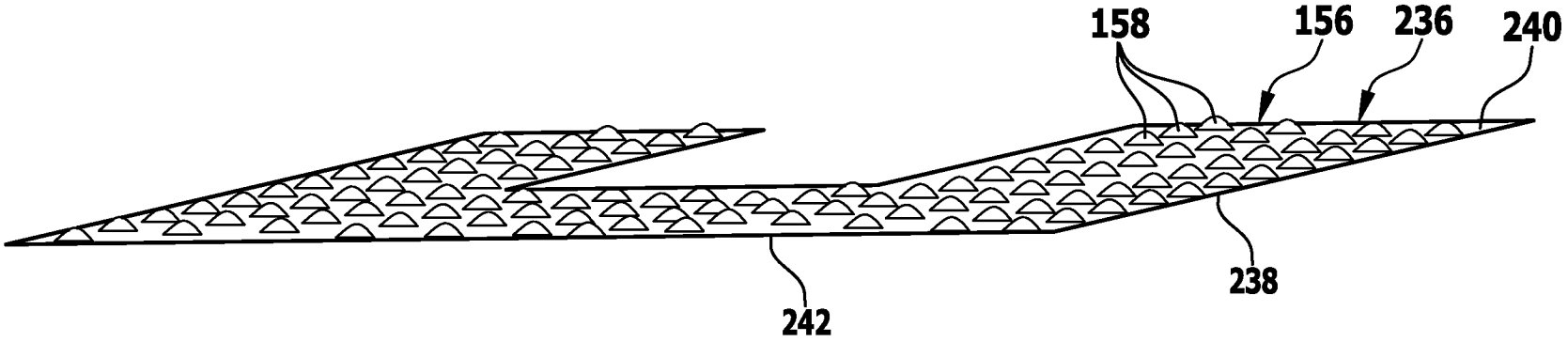
FIG. 14 shows a schematic perspective view of the support element of FIG. 18, viewed obliquely from above.

In particular, in the embodiment of a support element 236 according to FIGS. 13 and 14, the outer contour 238 thereof matches the outer contour 280 of the combined stimulus induction zone 154*d* on the rear side of the shirt 100 (see FIG. 2).

A support element of this type can be manufactured, for example, as an injection moulded part or as a film of a suitable plastics material.

Alternatively thereto, the support element 236 can comprise a textile material, for example a knitted fabric.

The support element 236 is arranged on the base element 170 of the upper body article of apparel such that the stimulus-inducing functional elements 158 lie on a front side 240 of the support element 236 facing away from the base element 170 of the upper body article of apparel and, in the worn state of the upper body article of apparel, face toward the body of the wearer.

Figure 15:
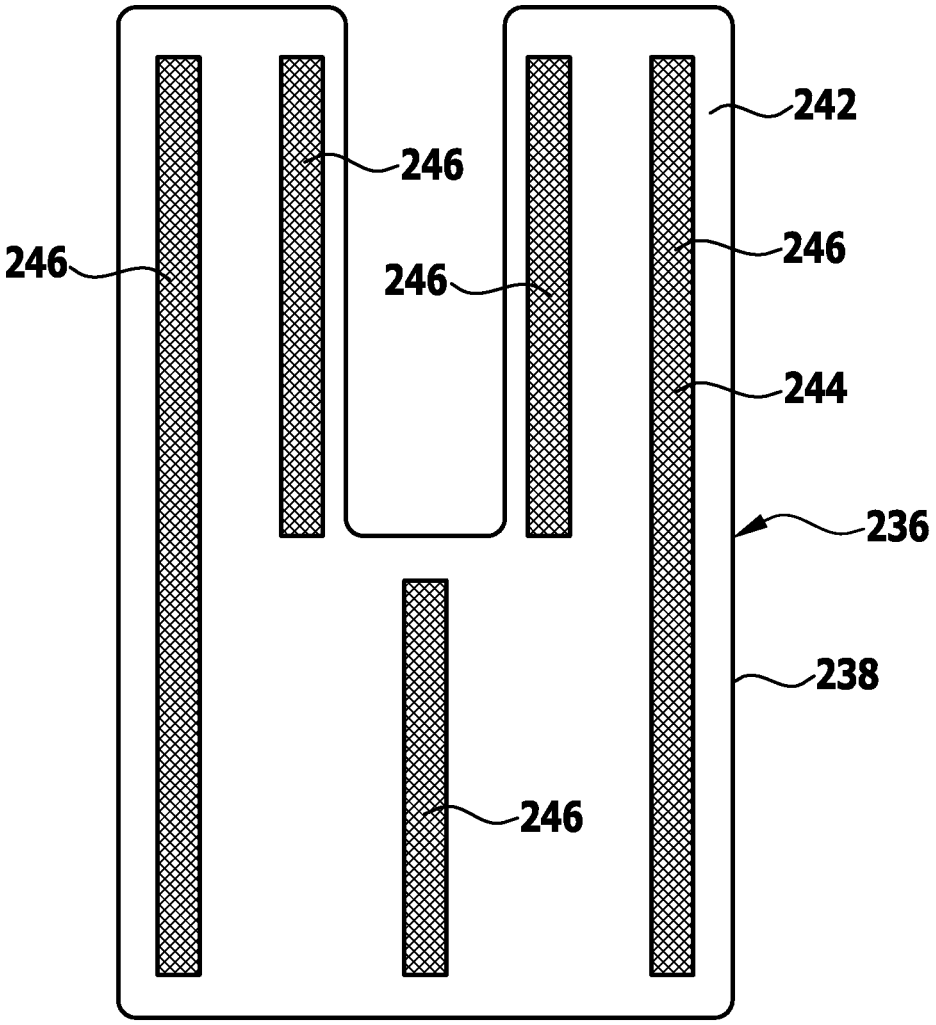
FIG. 15 shows a schematic plan view of a rear side of a support element facing away from the stimulus-inducing functional elements, the support element being provided with adhesive elements for releasable connection to a base element of an upper body article of apparel.

The rear side 242 of the support element 236 shown in FIG. 15 which, in the mounted state of the support element 236, faces toward the base element 170 of the upper body article of apparel can be provided with fastening devices 244. The fastening devices 244 can be configured, for example, as adhesion elements 246 which cooperate with adhesion elements (not shown) on the base element 170 of the upper body article of apparel in order to fasten the support element 236 releasably on the base element 170 of the upper body article of apparel.

In particular, the adhesion elements 246 can form a constituent part of a touch-and-close fastener or a hook-and-loop fastener.

Figure 16:
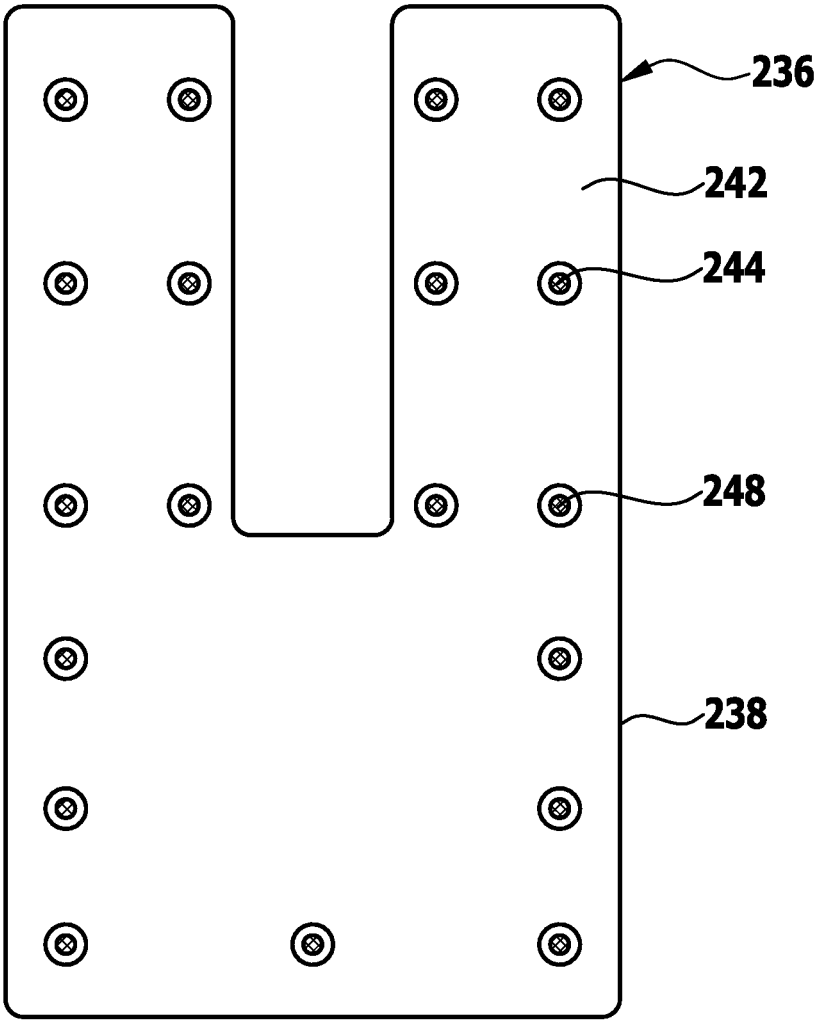
FIG. 16 shows a schematic plan view of a rear side of a support element facing away from the stimulus-inducing functional elements, the support element being provided with press fasteners for releasable connection to a base element of the upper body article of apparel.

In an alternative embodiment of a support element 236, illustrated in FIG. 16, which is releasably fastenable to the base element 170 of the upper body article of apparel, the fastening devices 244 are configured as locking elements 248 which are lockable to base element-side locking elements (not shown), in order to fasten the support element 236 releasably on the base element 170 of the upper body article of apparel.

In particular, it can be provided that at least one support element-side locking element 248 and a base element-side locking element cooperating therewith together form a press fastener.

Figure 17:
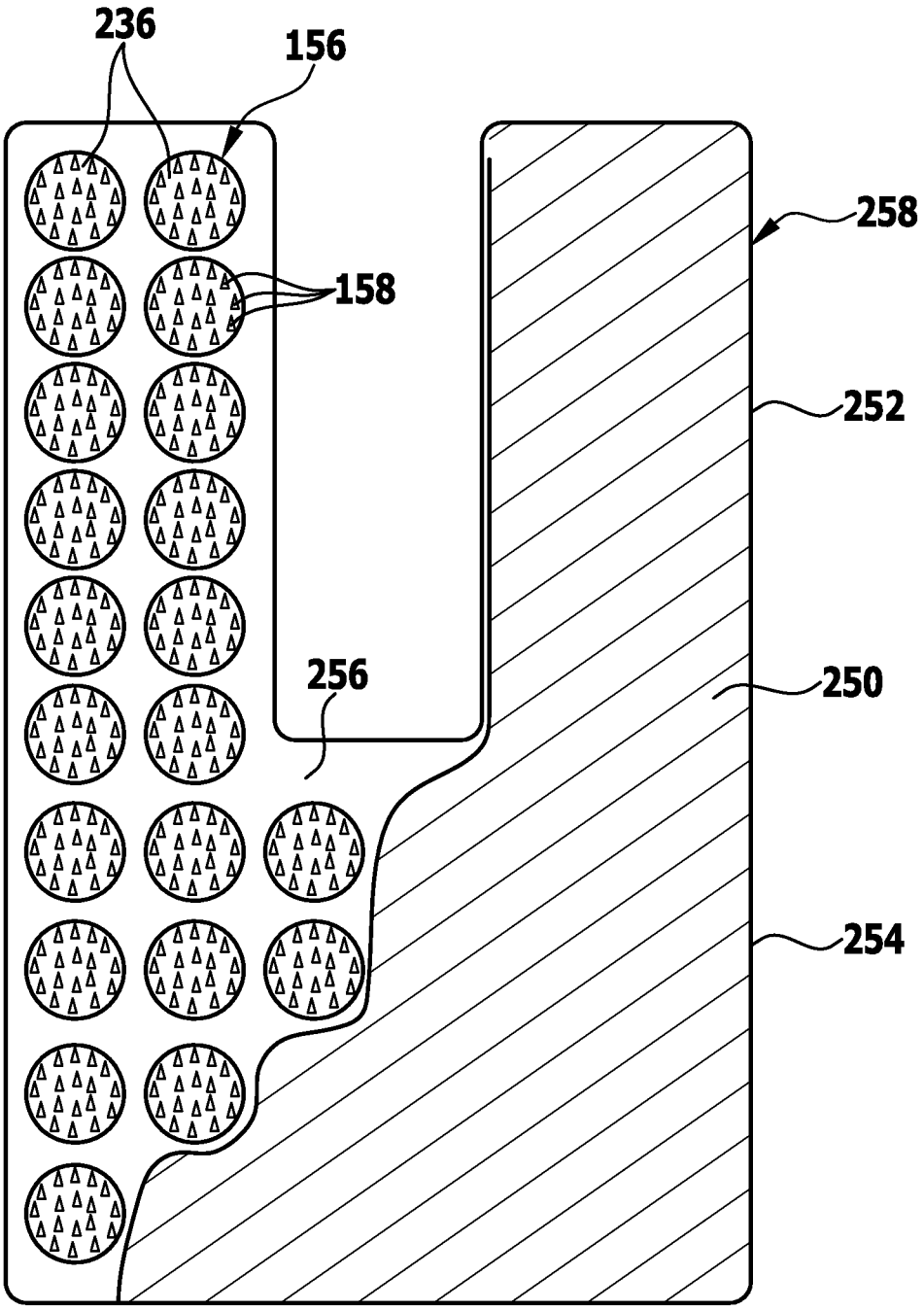
FIG. 17 shows a schematic plan view of a pocket which contains a plurality of support elements, each of which comprises a plurality of stimulus-inducing functional elements, wherein part of a front side of the pocket facing the skin of the wearer in the worn state of the upper body article of apparel is broken away to show the support elements with the stimulus-inducing functional elements.
Figure 18:
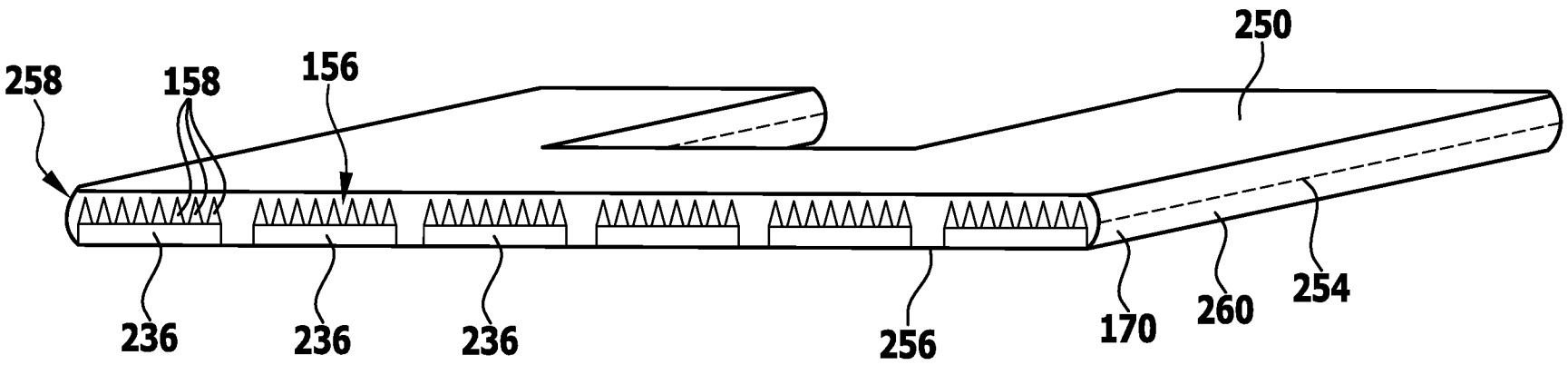
FIG. 18 shows a schematic perspective, partially sectional view of the pocket with the support elements of FIG. 17.

In an alternative embodiment of the stimulus-inducing structure 126 of a stimulus induction zone 154 shown in FIGS. 17 and 18, it is provided that, in the worn state of the upper body article of apparel, the functional elements 158 do not make direct contact with the skin of the wearer of the upper body article of apparel, but rather that, in the worn state of the upper body article of apparel, a covering 250 is arranged between the functional elements 158 and the body of the wearer.

The covering 250 can be formed, for example, from a textile material or a film, in particular a plastics film.

An outer contour 252 of the covering 250 preferably substantially matches the outer contour 280 of the relevant stimulus induction zone 154.

As can be best seen from FIG. 18, the covering 250 can be connected, for example, by means of a seam 254, to a rear wall 256 manufactured separately from the base element 170, for example from a textile material or a film, in particular a plastics material and, together with the rear wall 256, can thus form a pocket 258 in which the functional elements 158 of the stimulus-inducing structure 156 are accommodated.

The pocket 258 is assembled from the covering 250 and the rear wall 256 separately from the base element 170 before the pocket 258 as a whole is non-releasably or releasably fastened to the base element 170 of the upper body article of apparel.

The pocket 258 can be closed along its outer contour or can have an opening through which the functional elements 158 and, in particular, the support elements 236 supporting the functional elements 158 can be introduced into the pocket 258.

It can herein be provided that all the functional elements 158 of the stimulus-inducing structure 156 are arranged on a single support element 236.

In the embodiment shown in FIGS. 17 and 18, it is alternatively provided that the stimulus-inducing structure 156 has a plurality of support elements 236, each of which carries a plurality of stimulus-inducing functional elements 158.

The support elements 236 can be manufactured separately from the covering 250 and separately from the rear wall 256 and subsequently connected to the rear wall 256 and/or to the covering 250, for example, by adhesion, welding and/or sewing.

Furthermore, it could also be provided that the rear side of the pocket 258 opposing the covering 250 is not formed by means of a rear wall 256 configured separately from the base element 170, but rather by means of a section 260 of the base element 170.

In this case, the support elements 236 are connected to the section 260 of the base element 170, for example, by means of adhesion, welding and/or sewing.

Furthermore, it can be provided that arranged in the pocket 258 is a biasing element (not shown) which, in the worn state of the upper body article of apparel, biases the functional elements 158 toward the body of the wearer, in order thus to amplify the application pressure of the functional elements 158 onto the skin of the wearer through the covering 250.

A biasing element of this type can comprise, for example, a foam material inlay.

The use of such a biasing element can be useful, in particular, if the body of the wearer of the upper body article of apparel is concavely shaped in the region in which the relevant stimulus induction zone 154 is arranged.

The use of a covering 250 between the functional elements 158 and the body of the wearer of the upper body article of apparel is particularly advantageous if the functional elements 158 are configured relatively hard, relatively high and/or relatively pointed.

The invention claimed is:

1. Upper body article of apparel, in particular a shirt, a bodysuit, an undershirt or an oversleeve, which comprises at least one compression region in which, in a worn state, the upper body article of apparel is to exert a compression effect on a body of a wearer of the upper body article of apparel, and comprises at least one stimulus-inducing structure which is arranged on an inside of the upper body article of apparel to be facing, in the worn state, toward the body of the wearer of the upper body article of apparel, wherein the stimulus-inducing structure comprises a plurality of stimulus-inducing functional elements arranged within a stimulus induction zone delimited by an outer contour of the respective stimulus-inducing structure, wherein the plurality of functional elements of the at least one stimulus-inducing structure are isolated from one another and an area density of the plurality of functional elements within the at least one stimulus-inducing structure is at least 1 per $cm^2$, wherein the upper body article of apparel comprises a basic knit material, wherein the plurality of functional elements each comprise a knitted region of the basic knit material of the upper body article of apparel, wherein the knitted region of each of the plurality of functional elements differs, with regard to a knitted construction of the knitted region of the respective functional element, from a knitted region of the basic knit material of the upper body article of apparel adjoining and surrounding the respective functional element, wherein the knitted region of the respective functional element is configured as a tuck stitch fabric and contains a thread comprising an elastic polymer, wherein the knitted region of the respective functional element comprises a plurality of tuck stitch loops that extend over a plurality of stitch rows, wherein the plurality of functional elements each have a largest extent along a surface direction of the basic knit material of the upper body article of apparel of more than 0.2 cm and of not more than 1.0 cm, and wherein the plurality of functional elements, in the worn state of the upper body article of apparel, is to be in direct contact with skin of the wearer of the upper body article of apparel.

2. Upper body article of apparel according to claim 1, wherein the stimulus-inducing structure is arranged at least partially in the at least one compression region of the upper body article of apparel.

3. Upper body article of apparel according to claim 1, wherein the compression region of the upper body article of apparel comprises a knitted fabric.

4. Upper body article of apparel according to claim 1, wherein the compression region of the upper body article of apparel comprises at least one elastic yarn.

5. Upper body article of apparel according to claim 1, wherein the compression region has a gradual progression of a compression strength.

6. Upper body article of apparel according to claim 1, wherein a maximum compression strength in the compression region is at least approximately 7 mm Hg.

7. Upper body article of apparel according to claim 1, wherein at least one compression region comprises one or more of at least a part of a trunk region, at least a part of an upper arm region and at least a part of a forearm region of the upper body article of apparel.

8. Upper body article of apparel according to claim 1, wherein at least one functional element is configured as a raised portion.

9. Upper body article of apparel according to claim 1, wherein at least one functional element comprises one or more of a thermoplastic polymer and a thermosetting polymer.

10. Upper body article of apparel according to claim 1, wherein the knitted region of the functional element contains a hot-melt adhesive thread.

11. Upper body article of apparel according to claim 1, wherein at least one functional element is configured locally delimited.

12. Upper body article of apparel according to claim 1, wherein a height of at least one functional element is at least approximately 0.1 cm.

13. Upper body article of apparel according to claim 1, wherein at least one functional element has a Shore A hardness of at least approximately 20.

14. Upper body article of apparel according to claim 1, wherein at least one functional element is fastened to a base element of the upper body article of apparel.

15. Upper body article of apparel according to claim 1, wherein at least one stimulus-inducing structure comprises at least one support element on which a plurality of functional elements are provided.

16. Upper body article of apparel according to claim 15, wherein at least one support element is fixed to a base element of the upper body article of apparel.

17. Upper body article of apparel according to claim 15, wherein at least one support element is releasably connected to a base element of the upper body article of apparel.

18. Upper body article of apparel according to claim 1, wherein, in the worn state of the upper body article of apparel, at least one stimulus-inducing structure is to at least partially overlap a thoracolumbar fascia of the wearer of the upper body article of apparel.

19. Upper body article of apparel according to claim 1, wherein, in the worn state of the upper body article of apparel, at least one stimulus-inducing structure is to at least partially overlap an erector spinae muscle group.

20. Upper body article of apparel according to claim 19, wherein at least one stimulus-inducing structure is to at least partially overlap the erector spinae muscle group extends, in the worn state of the upper body article of apparel, to approximately a height of thoracic vertebra T 10.

21. Upper body article of apparel according to claim 1, wherein, in the worn state of the upper body article of apparel, at least one stimulus-inducing structure is to at least partially overlap triceps brachii muscles.

22. Upper body article of apparel according to claim 1, wherein, in the worn state of the upper body article of apparel, at least one stimulus-inducing structure is to at least partially overlap extensors of a forearm of the wearer.

23. Upper body article of apparel according to claim 1, wherein, in the worn state of the upper body article of apparel, no spinous processes of a vertebral column of the wearer of the upper body article of apparel are to be in contact with any stimulus-inducing structure of the upper body article of apparel.

24. Upper body article of apparel according to claim 1, wherein the upper body article of apparel has at least two stimulus-inducing structures which are separated from one another by a region without any stimulus-inducing structure.

25. Upper body article of apparel according to claim 1, wherein the upper body article of apparel is provided with at least one marking which serves as a positioning aid for positioning at least one stimulus-inducing structure of the upper body article of apparel relative to the body of the wearer during putting on of the upper body article of apparel.

26. Upper body article of apparel according to claim 1, wherein the stimulus-inducing structure comprises a plurality of stimulus-inducing functional elements and wherein all of the plurality of functional elements have a largest extent along the surface direction of the basic knit material of the upper body article of apparel of not more than 1.0 cm.

27. Upper body article of apparel according to claim 1, wherein, in the worn state of the upper body article of apparel, the outer contour of the at least one stimulus-inducing structure is to substantially correspond to an outer contour of extensors of a forearm of the wearer of the upper body article of apparel.

28. Upper body article of apparel according to claim 1, wherein two stimulus induction zones in the form of strips which, in the worn state of the upper body article of apparel, at least partially overlap an erector spinae muscle group, are arranged left and right of a spinal column line, parallel to the spinal column line, and are spaced from one another perpendicular to the spinal column line, wherein each of the strips extends upwardly at least to a height of a vertebra T 10.

29. Upper body article of apparel according to claim 1, wherein, in the worn state of the upper body article of apparel, the outer contour of the at least one stimulus-inducing structure is to substantially correspond to an outer contour of an erector spinae muscle group.

30. Upper body article of apparel, in particular a shirt, a bodysuit or an undershirt, which comprises at least one compression region in which, in a worn state, the upper body article of apparel is to exert a compression effect on a body of a wearer of the upper body article of apparel, and comprises at least one stimulus-inducing structure which is arranged on an inside of the upper body article of apparel to be facing, in the worn state, toward the body of the wearer of the upper body article of apparel, wherein the stimulus-inducing structure comprises a plurality of stimulus-inducing functional elements arranged within a stimulus induction zone delimited by an outer contour of the respective stimulus-inducing structure, wherein the plurality of functional elements of the at least one stimulus-inducing structure are isolated from one another, wherein the upper body article of apparel comprises a basic knit material, wherein each of the plurality of functional elements comprises a knitted region of the upper body article of apparel which, with regard to the knitted construction of the knitted region of the respective functional element, differs from a knitted region of the basic knit material of the upper body article of apparel adjoining and surrounding the respective functional element, wherein the knitted region of the respective functional element is configured as a tuck stitch fabric and contains a thread comprising an elastic polymer, wherein the knitted region of the respective functional element comprises a plurality of tuck stitch loops that extend over a plurality of stitch rows, wherein all of the plurality of functional elements have a largest extent along a surface direction of a basic knit material of the upper body article of apparel of more than 0.2 cm and of not more than 1.0 cm, wherein a surface density of the plurality of functional elements within the at least one stimulus-inducing structure is at least 1 per $cm^2$, wherein, in the worn state of the upper body article of apparel, the outer contour of the at least one stimulus-inducing structure is to substantially correspond to an outer contour of an erector spinae muscle group, and wherein no spinous processes of a vertebral column of the wearer of the upper body article of apparel are to be in contact with any stimulus-inducing structure of the upper body of article.

31. Upper body article of apparel according to claim 1, wherein the at least one stimulus-inducing structure includes first, second and third stimulus induction zones, wherein the first and second stimulus induction zones include first and second strips, respectively, which, in the worn state of the upper body article of apparel, are positioned left and right of a spinal column line, parallel to the spinal column line, and are spaced apart from one another and the spinal column line, and wherein the first and second strips adjoin the third stimulus induction zone that extends across the spinal column line.

32. Upper body article of apparel according to claim 31, wherein the first, second and third stimulus induction zones define a generally u-shaped stimulus inducing structure.

33. Upper body article of apparel according to claim 1, wherein, in the worn state of the upper body article of apparel, the outer contour of the at least one stimulus-inducing structure is to substantially correspond to an outer contour of the triceps brachii muscles of the wearer of the upper body article of apparel.

* * * * *